US011127257B2

(12) United States Patent
Russell et al.

(10) Patent No.: US 11,127,257 B2
(45) **Date of Patent: *Sep. 21, 2021**

(54) SYSTEM FOR PLACING WAGERS ON SPORTING EVENTS AND METHOD OF OPERATING SAME

(71) Applicant: SBC Nevada, LLC, Las Vegas, NV (US)

(72) Inventors: Michael J. Russell, Las Vegas, NV (US); Vic Salerno, Henderson, NV (US)

(73) Assignee: SBCC IP LLC, Las Vegas, NV (US)

( * ) Notice: Subject to any disclaimer, the term of this patent is extended or adjusted under 35 U.S.C. 154(b) by 136 days.

This patent is subject to a terminal disclaimer.

(21) Appl. No.: 16/432,441

(22) Filed: Jun. 5, 2019

(65) Prior Publication Data

US 2019/0287351 A1 Sep. 19, 2019

Related U.S. Application Data

(63) Continuation of application No. 15/341,341, filed on Nov. 2, 2016, now Pat. No. 10,360,767.

(60) Provisional application No. 62/257,613, filed on Nov. 19, 2015, provisional application No. 62/331,182, filed on May 3, 2016.

(51) Int. Cl.
*G07F 17/32* (2006.01)

(52) U.S. Cl.
CPC ..... *G07F 17/3288* (2013.01); *G07F 17/323* (2013.01); *G07F 17/3239* (2013.01); *G07F 17/3241* (2013.01); *G07F 17/3244* (2013.01); *G07F 17/3248* (2013.01)

(58) Field of Classification Search
CPC ..... G07F 17/3288; G07F 17/3241; G07F 17/3239; G07F 17/323; G07F 17/3244; G07F 17/3248
USPC ..... 463/25
See application file for complete search history.

(56) References Cited

U.S. PATENT DOCUMENTS

| | | | | |
|---|---|---|---|---|
| 7,419,428 | B2 | 9/2008 | Rowe | |
| 8,282,471 | B1 | 10/2012 | Korner | |
| 2003/0171145 | A1 | 9/2003 | Rowe | |
| 2004/0230516 | A1* | 11/2004 | Crosthwaite | G06Q 40/025 705/37 |
| 2005/0096124 | A1* | 5/2005 | Stronach | G07F 17/3288 463/25 |

(Continued)

*Primary Examiner* — Michael A Cuff
(74) *Attorney, Agent, or Firm* — Howard & Howard Attorneys PLLC

(57) ABSTRACT

A computer server system for use in placing wagers on live sporting events is described herein. The server system includes a database and a server computer. The database includes a list of user account records and a list of wagering event records. Each wagering event record including a receiving book ID and information associated with a wagering event including one or more betting lines. The receiving book ID associated with a receiving booking entity associated with the wagering event. Each user account record including a unique user ID and a home book ID. The home book ID associated with a home booking entity. The server computer is programmed to generate a unique booking record including a unique session ID, a home book ID, a receiving book ID, and a wagering event record associated with a wager.

20 Claims, 25 Drawing Sheets

(56) References Cited

U.S. PATENT DOCUMENTS

| | | | | |
|---|---|---|---|---|
| 2005/0227757 | A1* | 10/2005 | Simon | G07F 17/32 463/25 |
| 2010/0151935 | A1* | 6/2010 | Platis | G07F 17/32 463/25 |
| 2011/0003634 | A1 | 1/2011 | Manteris | |
| 2011/0065494 | A1 | 3/2011 | Kennedy et al. | |
| 2012/0136779 | A1* | 5/2012 | Nonaka | G06Q 20/065 705/39 |
| 2012/0295698 | A1* | 11/2012 | Demino | G07F 17/3258 463/28 |
| 2013/0217475 | A1 | 8/2013 | Guan | |
| 2014/0323207 | A1 | 10/2014 | Lee | |
| 2014/0324680 | A1* | 10/2014 | Sanford | G06Q 20/227 705/39 |
| 2015/0235521 | A1 | 8/2015 | Lutnick | |
| 2015/0279155 | A1* | 10/2015 | Chun | G07F 17/3234 463/25 |
| 2015/0287278 | A1* | 10/2015 | Shore | G07F 17/3223 463/29 |
| 2016/0171829 | A1* | 6/2016 | Sanford | G07F 17/3244 463/25 |
| 2016/0300440 | A1 | 10/2016 | Ortiz et al. | |
| 2017/0017657 | A1* | 1/2017 | English | G07F 17/323 |
| 2017/0140605 | A1* | 5/2017 | Lewski | G07F 17/323 |
| 2017/0206742 | A1 | 7/2017 | De Knijff | |
| 2017/0243438 | A1 | 8/2017 | Merati | |
| 2019/0180558 | A1* | 6/2019 | Merati | G06Q 20/3678 |

* cited by examiner

76

76

54

| | 58 | 60 | 62 | 48 | 46 | 64 | 66 |
|---|---|---|---|---|---|---|---|
| | Session ID | User ID | Home Book ID | Receiving Book ID | Wager Record ID | Wager Amount | Verification ID |
| 56 | Ses001001 | Adam01 | Book01 | Book032 | Wager020 | $100 | Verify001 |
| | Ses001002 | Bruce02 | Book032 | Book024 | Wager001 | $50 | Verify002 |
| 56 | Ses002301 | Dan04 | Book01 | Book043 | Wager1025 | $200 | Verify003 |

FIG. 28

68

| | 60 | 62 |
|---|---|---|
| | User ID | Home Book ID |
| 70 | Adam01 | Book01 |
| | Bruce02 | Book032 |
| 70 | Dan04 | Book01 |

FIG. 29

42

50

46 48

| Wagering event record ID | Receiving Book ID | Sporting Event | Teams | Betting Lines |
|---|---|---|---|---|
| Wager020 | Book032 | Baseball001 | Team01, Team02 | +200/-150 |
| Wager001 | Book024 | Baseball001 | Team01, Team02 | +210/-100 |
| Wager1025 | Book043 | Baseball001 | Team01, Team02 | +180/-130 |
| Wager102 | Book032 | Football023 | Team11, Team23 | -100/+150 |
| Wager105 | Book024 | Football023 | Team11, Team23 | -110/+150 |
| Wager110 | Book043 | Football023 | Team11, Team23 | -100/+200 |

44

44

FIG. 30

52

Page 1 of 1

AW Activity Detail

Printed: 20-Apr-16 at 09:03:50

By: RICH

Op. Date Range: 01-Jan-16 to 21-Apr-16
Location Grouping: Reporting Location
Location: WESTGATE
Account: 6020

| Date/Time | ETSN | Trans. Type / Description | User | Terminal/Device | Amount |
|---|---|---|---|---|---|
| **Location: WESTGATE** | | | | | |
| **Account: 6020 (Miomni Test Patron 6020)** | | | | | |
| 17-Apr-2016, 12:17:41 | | ACCT WITHDRAWAL (58)<br>SBC: 2345-dsasadasdasd-as | (none) | (none) | -55.00 |
| 20-Apr-2016, 07:11:48 | | ACCT DEPOSIT (58)<br>SBC: 2345-dsasadasdasd-as | (none) | (none) | 105.00 |

Total Account 6020 (Miomni Test Patron 6020)

| Begin Balance | Deposits | Withdraw. | Adjustment | Total Cash | Tickets Sold | Tickets Voided | Tickets Paid | Net Win | Taxes | Ending Balance |
|---|---|---|---|---|---|---|---|---|---|---|
| 55.00 | 105.00 | -55.00 | 0.00 | 50.00 | 0.00 | 0.00 | 0.00 | 0.00 | 0.00 | 105.00 |

Net Write: 0.00

Total Location: WESTGATE

| Begin Balance | Deposits | Withdrawals | Adjustment | Total Cash | |
|---|---|---|---|---|---|
| 55.00 | 105.00 | -55.00 | 0.00 | 50.00 | |
| **Tickets Sold** | **Tickets Voided** | **Tickets Paid** | **Net Win** | **Total Taxes** | **Ending Balance** |
| 0.00 | 0.00 | 0.00 | 0.00 | 0.00 | 105.00 |

Net Write: 0.00

FIG. 31

52

Page 1 of 1

AW Activity Detail

Printed: 20-Apr-16 at 09:03:50

By: RICH

Op. Date Range: 01-Jan-16 to 21-Apr-16
Location Grouping: Reporting Location
Location: WYNN
Account: 6002

| Date/Time | ETSN | Trans. Type / Description | User | Terminal/Device | Amount |
|---|---|---|---|---|---|
| **Location: WYNN** | | | | | |
| **Account: 6002 (Miomni Test Book 6002)** | | | | | |
| 17-Apr-2016, 12:17:41 | | ACCT DEPOSIT (58)<br>SBC: 2345-dsasadasdasd-as | [none] | [none] | 55.00 |
| 17-Apr-2016, 12:17:41 | D644F131XXX | TICKET SOLD (58)<br>SBC: 2345-dsasadasdasd-as<br>STRAIGHT BET<br>20-APR [727] BALTIMORE RAVENS -2.5 -110 | [none] | [none] | -55.00 |
| 20-Apr-2016, 07:11:48 | D644F131XXX | TICKET PAID<br>SBC: 2345-dsasadasdasd-as<br>STRAIGHT BET<br>20-APR [727] BALTIMORE RAVENS -2.5 -110 | [none] | [none] | 105.00 |
| 20-Apr-2016, 07:11:48 | | ACCT WITHDRAWAL<br>SBC: 2345-dsasadasdasd-as | [none] | [none] | -105.00 |

Total Account 6002 (Miomni Test Book 6002)

| Begin Balance | Deposits | Withdraw. | Adjustment | Total Cash | Tickets Sold | Tickets Voided | Tickets Paid | Net Win | Taxes | Ending Balance |
|---|---|---|---|---|---|---|---|---|---|---|
| 0.00 | 55.00 | -105.00 | 0.00 | -50.00 | -55.00 | 0.00 | 105.00 | 50.00 | 0.00 | 0.00 |

Net Write
-55.00

Total Location: WYNN

| Begin Balance | Deposits | Withdrawals | Adjustment | Total Cash | |
|---|---|---|---|---|---|
| 0.00 | 55.00 | -105.00 | 0.00 | -50.00 | |
| **Tickets Sold** | **Tickets Voided** | **Tickets Paid** | **Net Win** | **Total Taxes** | **Ending Balance** |
| -55.00 | 0.00 | 0.00 | 50.00 | 0.00 | 0.00 |

Net Write
-55.00

FIG. 32

SYSTEM FOR PLACING WAGERS ON SPORTING EVENTS AND METHOD OF OPERATING SAME

CROSS-REFERENCE TO RELATED APPLICATION

This application is a continuation of U.S. patent application Ser. No. 15/341,341, filed Nov. 2, 2016, which claims the benefit of U.S. Provisional Patent Application Ser. No. 62/257,613, filed on Nov. 19, 2015, and claims the benefit of U.S. Provisional Patent Application Ser. No. 62/331,182, filed on May 3, 2016, all of which are hereby incorporated by reference in their entirety for all purposes.

COPYRIGHT NOTICE

The figures included herein contain material that is subject to copyright protection. The copyright owner has no objection to the facsimile reproduction by anyone of this patent document as it appears in the U.S. Patent and Trademark Office, patent file or records, but reserves all copyrights whatsoever in the subject matter presented herein.

TECHNICAL FIELD

The present invention relates to systems for use in placing wagers on live sporting events and methods of operating a system for placing wagers on live sporting events using mobile computing devices.

BACKGROUND OF THE INVENTION

Sports betting has become a popular activity at casinos and sportsbooks by allowing a person to place wagers on the final outcomes of sporting events thus increasing a person's interest in the outcome and enjoyment of watching the sporting event. The legal sports betting market in Nevada is over $4B a year with independently run sports books with separate betting lines, 25% of which is conducted on mobile apps. Sports betting customers cannot easily 'shop' (i.e., find the best possible bet) between different sports books. At least some known sports book/mobile app provides one bet option for a bet on a specific type of outcome (i.e. one option for the odds on Team A beating Team B at each book), which can vary significantly between locations. Brick & mortar sports books are effectively geographically limited to either local customers or tourists. Additionally, there are logistical barriers (finite betting resources and in-person deposit requirements) that prevent customers from opening up multiple mobile wagering accounts. Sports books make money through the volume of placed bets; therefore barriers for customers are also barriers to sports book profitability.

The current sports wagering business model is inefficient for the sports books and their customers. Increasing the efficiency of conducting sports betting transactions provides value to both parties. Accordingly, there is a continued need for legal and regulated systems and methods that provide the choice of where to place a wager that is most favorable to the customer and increase business for the sports books and provide ways to connect sports books and their customers and facilitate a greater number of and more efficient transactions.

SUMMARY OF THE INVENTION

In one aspect of the present invention, a sports wagering computer system is provided. The system allows a user to have a single sports book wagering account and still choose the most favorable betting line from a list of lines offered at multiple sports books, allow the user to place wagers on live sporting events, and automate "lay-off" transactions between books wherein a "lay-off" transaction includes a sports book placing a wager with another sports book at the lines posted.

In another aspect of the present invention, a computer server system for use in placing wagers on live sporting events is provided. The computer server system includes a database and a system server computer. The database includes a list of user account records and a list of wagering event records. Each wagering event record includes a receiving book ID and information associated with a wagering event including one or more betting lines. The receiving book ID is associated with a receiving booking entity associated with the wagering event. Each user account record includes a unique user ID and a home book ID. The home book ID is associated with a home booking entity having a user wagering account associated with a user. The system server computer includes a processor that is programmed to install an application program on a mobile computing device. The mobile computing device includes a processor, a memory device, and a touchscreen, the memory device having the application program stored therein that, when executed, causes the processor of the mobile computing device to display a graphical user interface via the touchscreen. The system server computer receives, from the mobile computing device, a unique user ID associated with the user and accesses the database and determines a user account record associated with the unique user ID. The system server computer generates a unique booking record including a unique session ID and stores the unique booking record in the database. The system server computer determines a home book ID included in the user account record and modifies the unique booking record to include the home book ID. The system server computer also accesses the list of wagering events records being stored in the database and displays a wagering screen including a plurality of wagering event selectors on the graphical user interface of the mobile computing device. Each wagering event selector indicates a wagering event associated with a corresponding wagering event record and includes a betting line. The system server computer receives, from the mobile computing device, a signal including a selection of a wagering event from the user via the touchscreen and a wager amount, identifies the receiving book ID included in the wagering event record associated with the selected wagering event and modifies the unique booking record to include the identified receiving book ID and the wagering event record. The system server computer also generates and transmits a signal to a middleware server including the unique booking record and a request to place a wager associated with the selected wagering event. The middleware server identifies the home booking entity and the receiving booking entity associated with the request and processes the wager between the home booking entity and the receiving booking entity.

In yet another aspect of the present invention, one or more non-transitory computer-readable storage media, having computer-executable instructions embodied thereon, is provided. The computer-executable instructions cause at least one processor to generate and store a list of user account records and a list of wagering event records in a database. Each wagering event record includes a receiving book ID and information associated with a wagering event including one or more betting lines. The receiving book ID is associated with a receiving booking entity associated with the wagering event. Each user account record includes a unique user ID and a home book ID. The home book ID is associated with a home booking entity having a user wagering account associated with a user. The processor installs an application program on a mobile computing device. The mobile computing device includes a processor, a memory device, and a touchscreen, the memory device having the application program stored therein that, when executed, causes the processor of the mobile computing device to display a graphical user interface via the touchscreen. The processor receives, from the mobile computing device, a unique user ID associated with the user and accesses the database and determine a user account record associated with the unique user ID. The processor generates a unique booking record including a unique session ID and stores the unique booking record in the database. The processor also determines a home book ID included in the user account record and modifies the unique booking record to include the home book ID. The processor then accesses the list of wagering events records being stored in the database and displays a wagering screen including a plurality of wagering event selectors on the graphical user interface of the mobile computing device. Each wagering event selector indicates a wagering event associated with a corresponding wagering event record and includes a betting line. The processor receives, from the mobile computing device, a signal including a selection of a wagering event from the user via the touchscreen and a wager amount, identifies the receiving book ID included in the wagering event record associated with the selected wagering event, and modifies the unique booking record to include the identified receiving book ID and the wagering event record. The processor then generates and transmits a signal to a middleware server including the unique booking record and a request to place a wager associated with the selected wagering event. The middleware server identifies the home booking entity and the receiving booking entity associated with the request and processing the wager between the home booking entity and the receiving booking entity.

In a further embodiment of the present invention, a method of operating a sports wagering computer system, is provided. The method includes a system server computer generating and storing a list of user account records and a list of wagering event records in a database. Each wagering event record includes a receiving book ID and information associated with a wagering event including one or more betting lines. The receiving book ID is associated with a receiving booking entity associated with the wagering event. Each user account record includes a unique user ID and a home book ID. The home book ID is associated with a home booking entity having a user wagering account associated with a user. The method includes the system server computer installing an application program on a mobile computing device which causes the mobile computing device to display a graphical user interface via the touchscreen. The method includes the system server computer receiving, from the mobile computing device, a unique user ID associated with the user and accessing the database and determine a user account record associated with the unique user ID. The method includes the system server computer generating a unique booking record including a unique session ID and storing the unique booking record in the database. The method also includes the system server computer determining a home book ID included in the user account record and modify the unique booking record to include the home book ID. The method further includes the system server computer accessing the list of wagering events records being stored in the database and display a wagering screen including a plurality of wagering event selectors on the graphical user interface of the mobile computing device. Each wagering event selector indicates a wagering event associated with a corresponding wagering event record and includes a betting line. The method includes the system server computer receiving, from the mobile computing device, a signal including a selection of a wagering event from the user via the touchscreen and a wager amount, identifying the receiving book ID included in the wagering event record associated with the selected wagering event, and modifying the unique booking record to include the identified receiving book ID and the wagering event record. The method also includes the system server computer generating and transmitting a signal to a middleware server including the unique booking record and a request to place a wager associated with the selected wagering event. The middleware server identifies the home booking entity and the receiving booking entity associated with the request and processes the wager between the home booking entity and the receiving booking entity.

In yet another embodiment of the present invention, a system for use in placing wagers on live sporting events, is provided. The system includes a database and a server computer. The database includes a list of betting lines. Each betting line including a plurality of betting attributes including at least one of a sport, a team, one or more betting lines. The server computer including a processor programmed to receive a unique user identification associated with the user from the mobile computing device, access a user profile list being stored in the database and determine a user account associated with the unique user ID, and determine a home booking entity associated with the user account. The home betting entity has a user wagering account associated with the user. The processor receives a request to display betting lines from a user via the mobile computing device. The request includes one or more betting line attributes. The processor accesses the database to retrieve betting lines having betting line attributes matching the requested betting line attributes and displays the retrieved betting lines on the mobile computing device. Each retrieved betting line has a corresponding receiving booking entity associated with the corresponding betting line. The processor receives a selection of a betting line from the user via the mobile computing device and receives a wager requests associated with the selected betting line including a bet amount. The processor transmits a request to the home book entity to adjust a credit balance of the user wagering account as a function of the wager request, determines a receiving booking entity associated with the selected betting line associated with the wager request, and determines a home booking betting account associated with the receiving booking entity associated with the wager request. The processor determines a home booking entity account identifier associated with home booking entity betting account and transmits a bet request to the receiving booking entity including the home booking entity account information and the wager request to facilitate the receiving booking entity to place the requested wager using the home booting entity account. The processor receives a verification notice indicating that the requested wager has been placed, receives a notification of the outcome of the wager and display the outcome to the user via the mobile computing device, and transmits a request to the home book entity to adjust a credit balance of the user wagering account as a function of the outcome of the wager.

BRIEF DESCRIPTION OF THE DRAWINGS

Other advantages of the invention will be readily appreciated as the same becomes better understood by reference to the following detailed description when considered in connection with the accompanying drawings wherein:

FIGS. 28-32 are exemplary illustrations of data records that may be used by the system shown in FIGS. 1-3, according to an embodiment of the present invention.

Corresponding reference characters indicate corresponding parts throughout the drawings.

DETAILED DESCRIPTION OF THE PREFERRED EMBODIMENT

Figure 1:
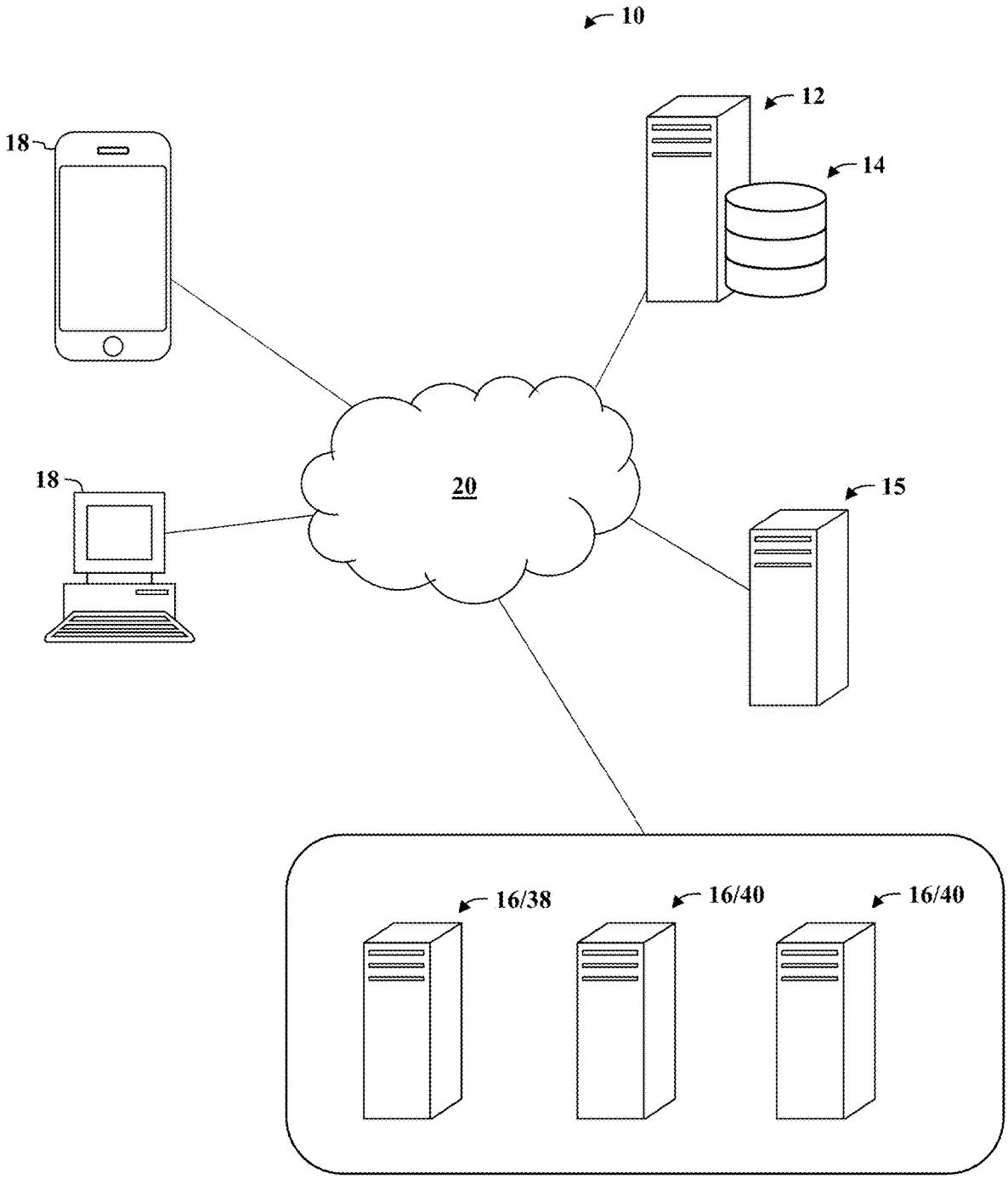
FIG. 1 is a schematic representation of an exemplary system for use in placing wagers on a live sporting event via mobile computing devices, according to an embodiment of the present invention.

With reference to the drawings and in operation, the invention overcomes some of the disadvantages of known betting systems by providing, among other things, systems and methods that allow a user to access the system to choose the most advantageous location to place wagers with one or more participating members of SBC's independent booking entities. Known sports book wagering systems only offers their own lines. The aggregation of multiple sports books' lines, listing the multiple sports books' lines, and letting the customer choose which line they want to bet from the list of lines while only having a single wagering account with one of the sports books with in the network is the key difference and what makes the present invention unique Sports Book Combine system is a system that aggregates and displays a list of lines allowing the customer to select which sports book they want to bet from out of a single bankroll.

In one embodiment, the customer creates an account with a partner sports book. Once the partner sports book receives the funds and fills out the paperwork, the customer is given an access ID and password. The customer can then access the system via a website, mobile website. mobile application, etc. and log in to their account. Once logged in, the customer selects a wager that he/she would like to place. Once this wager is displayed, the system shows the customer the available line/point spread and the customer chooses and then wagers on the bet they have selected.

In addition, in one embodiment, the system may allow the customer to "Choose a Line" where he/she would put in a bid for a line more favorable than any offered. If at any point one of the partner sports books line moves to the customer's chosen line the bet would automatically be placed. The partner sports books can log in to the system at any time to see a report of "Choose Your Line" wagers outstanding (i.e. not yet booked as bets because no books within the network of partner sports books has moved to these lines yet). In one embodiment, if none of the partner books have their lines move to the customer's "Choose Your Line" request within fifteen minutes before the start of the game then the request may be canceled and an email/text message notification is sent to the customer. The system may also identify customers willing to place a wager at a specific line and notifies the partner sports books, peer to operator.

Online aggregation and dissemination of sports book lines: The system will be directly linked into partner sports book systems to guarantee the most current lines. The customer selects a game he/she wishes to wager on and the betting lines from all partner sports books are shown. The system may display betting line information including, but not limited to: Home Point Spread—the number of points added to the home team's score and if they are still ahead then the bet wins; Away Point Spread—the number of points added to the away team's score and if they are still ahead then the bet wins; Home Money Line—the odds to bet the home team to win; Away Money Line—the odds to bet the away team to win; Futures option and parlay options; Over—the combined total score for both teams (must be more to win the bet); Under—the combined total score for both teams (must be less to win the bet); proposition bets; and/or any suitable betting line information associated with wager available from the partner sports books.

Sports Book Combine (SBC) system 10 is a disruptive sports betting technology that aggregates the lines of multiple Partner Sports Books and provides a single location for both 'shopping' (finding the best possible bet) and placing those bets.

Scope: SBC system 10 aggregates multiple betting lines from multiple books and allows the user to select the line they prefer to wager on, regardless of which book is offering this line. SBC will allow the customer to wager on this selected line from a single account they have opened with a partner sports book within the SBC network.

Account: The customer will be required to have one or more wagering accounts with a partner sports book, following the same policies/procedures that are currently in place for mobile app wagering with the sports book.

Wager: Once the customer selects the line they wish to bet on and indicate the amount, SBC sends a notification to the book where the customer's account resides indicating the wager request and amount and the partner sports book will reduce the customer's balance by the bet amount then "lay-off" the wager by placing the wager with the book where the selected line resides. For example. The customer has an account with Sports Book A (e.g. a home sports book) and the selected line is offered at a different Sports Book B (e.g. a receiving sports book) then Sports Book A will reduce the customer's balance by the wager amount (i.e. $100) and in turn place the wager with Sports Book B on the selected line for the $100 amount. SBC's software will automate this transaction.

Settlement of Wager: If the wager loses, no further action is taken, if the wager ties or wins then Sports Book B will settle the bet with the Sports Book A account and SBC will notify Sports Book A to credit the customer account with the amount of the settled wager.

Result: Sports Book A's account will always remain at a $0 balance as they are merely "laying off" the action to a sister book within the SBC network.

Use Case—Sports Books: Sports books desire to have an even amount wagered on each side of the line; making money regardless of the outcome. SBC provides Partner Sports Books with a liquidity vehicle to help balance their books more efficiently. For example, wagering in the Las Vegas Metropolitan area is evenly split between the Las Vegas Strip (Tourist) and Off-Strip (Local) locations. These bettors have different preferences (Tourists lean toward the Favorites and the Over, Locals the reverse). SBC connects Tourist locations with Local bettors and Local locations with Tourist bettors, increasing the opportunity for both books to balance their lines. SBC also can connect the Southern Nevada sports books with the Northern Nevada customers and vice-versa, further increasing the customer pool and liquidity. SBC's ability to allow customers to wager on any lines within the SBC network out of a single bankroll ensures that Partner Sports Books can take wagers from a customer which has separate multiple accounts with partner books even if their account balance is $0 at the book with the best odds, as long as they have a funded account at another Partner Sports Book.

Use Case—Sports Bettors: The overwhelming majority of sports bettors have a finite bankroll, limited time and lack of resources to 'shop' lines. SBC is a single app solution which allows for a shared bankroll and the ability to see multiple lines/place bets without switching between apps. SBC is significantly less expensive and more efficient than requiring a customer to visit multiple book websites or physically visit each sports book location to track line movements.

A selected embodiment of the invention will now be explained with reference to the drawings. It will be apparent to those skilled in the art from this disclosure that the following description of the embodiment of the invention is provided for illustration only and not for the purpose of limiting the invention as defined by the appended claims and their equivalents.

FIG. 1 is a schematic representation of the event wagering system 10, according to an embodiment of the invention. In the illustrated embodiment, the system 10 includes a system server 12, a database 14, a middleware server 15, a plurality of booking entity servers 16, and one or more mobile computing devices 18 that are coupled in communication via a communications network 20. The communications network 20 may be any suitable connection, including the Internet, file transfer protocol (FTP), an Intranet, a local area network (LAN), a wide area network (WAN), dial-in-connections, a virtual private network (VPN), cellular networks, and/or any suitable communications network, and may utilize any suitable or combination of technologies including, but not limited to wired and wireless connections, always on connections, connections made periodically, and connections made as needed.

Each mobile computing device 18 includes any suitable device that enables a user to access and communicate with the system 10 including sending and/or receiving information to and from the system 10, and displaying information received from the system 10 to a user. For example, in one embodiment, the mobile computing device 18 may include, but is not limited to, smartphone, a desktop computer, a laptop or notebook computer, a tablet computer, smartphone/tablet computer hybrid, a personal data assistant, a handheld mobile device including a cellular telephone, and the like. For example, in one embodiment, the mobile computing device 18 may include a smartphone such as, for example, an iPhone™.

In the illustrated embodiment, each booking entity server 16 is associated with an independent wagering entity and includes wagering information associated with live events and allows user to place wagers on various aspects of the live events. Each independent wagering entity may also establish betting lines associated with events, receive wagers associated with the event outcomes, and settle the wagers based on the amount of the wager and the corresponding betting line. For example, in one embodiment, each booking entity server 16 may be associated with a sports wagering book that provides a plurality of betting lines associated with live sporting contests. The sports wagering book may establish a plurality of betting lines associated with the outcomes of one or more sporting events, the performance of the teams and/or individuals participating in sporting events, and/or non-performance related events. The sports wagering book may also accept wagers placed on the outcomes of the sporting events and/or the performance of the participants based on the betting lines established by the sports wagering book. For example, the sports wagering book may establish a betting line for a sporting event that includes an expected event winner, total score, and/or score differential. The betting line may also include a potential monetary award for achieving a winning bet outcome and a wager amount required to place a bet associated with the outcome and the potential monetary award.

In addition, each booking entity server 16 may include one or more user wagering accounts that are associated with one or more users for use in placing wagers with the corresponding wagering entity. In addition, each booking entity server 16 may also include one or more booking entity accounts associated with the other independent wagering entities to allow the other independent wagering entities to place wagers with the current wagering entity.

In one embodiment, the middleware server 15 communicates with each of the booking entity servers 16 to facilitate transmitting wagering requests and processing wagers between the booking entity servers 16. In the illustrated embodiment, the middleware server 15 is configured to communicate with the system server 12 to facilitate processing wager requests received from the system server 12 with the booking entity servers 16.

Figure 2:
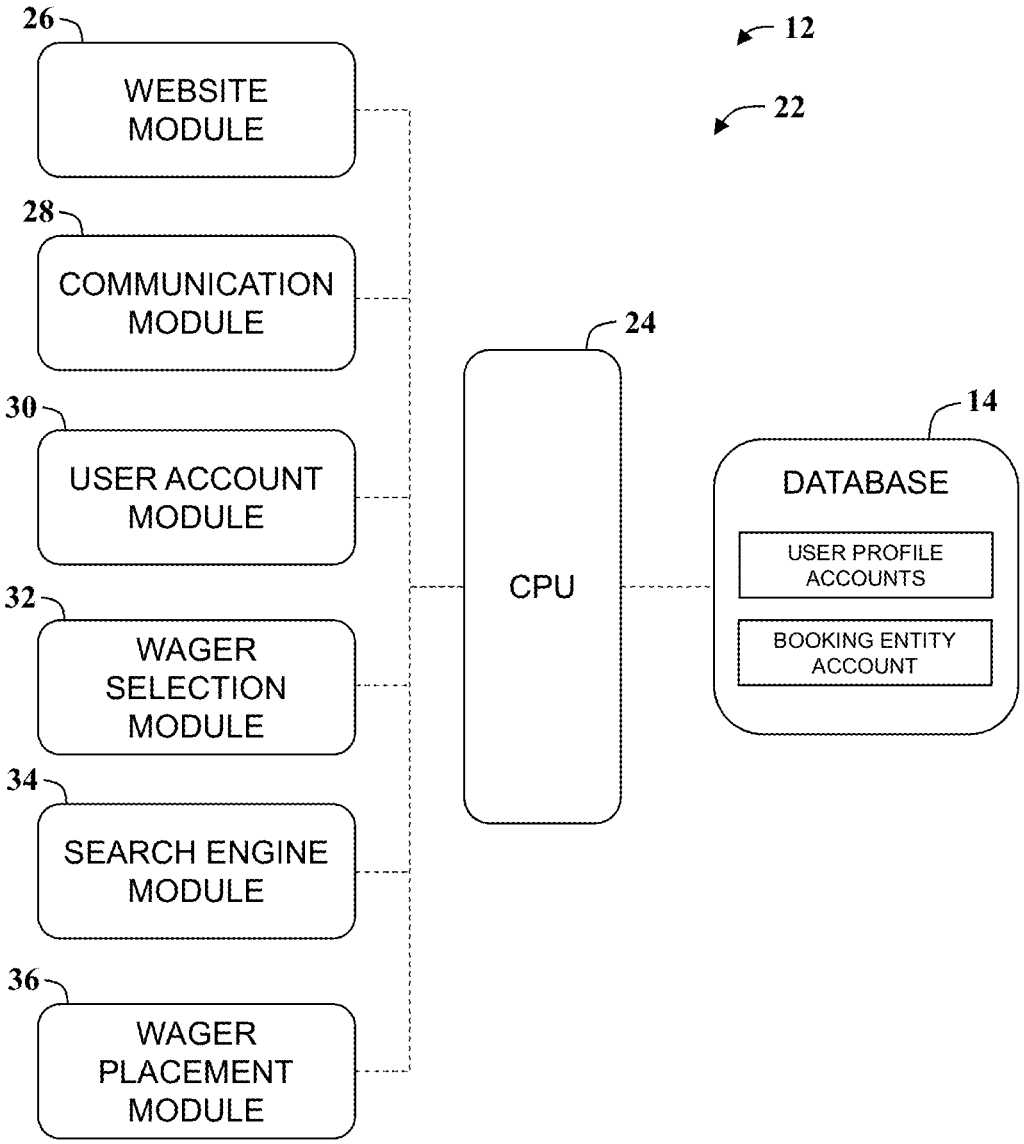
FIG. 2 is schematic view of a system controller that may be used with the system shown in FIG. 1.
Figure 3:
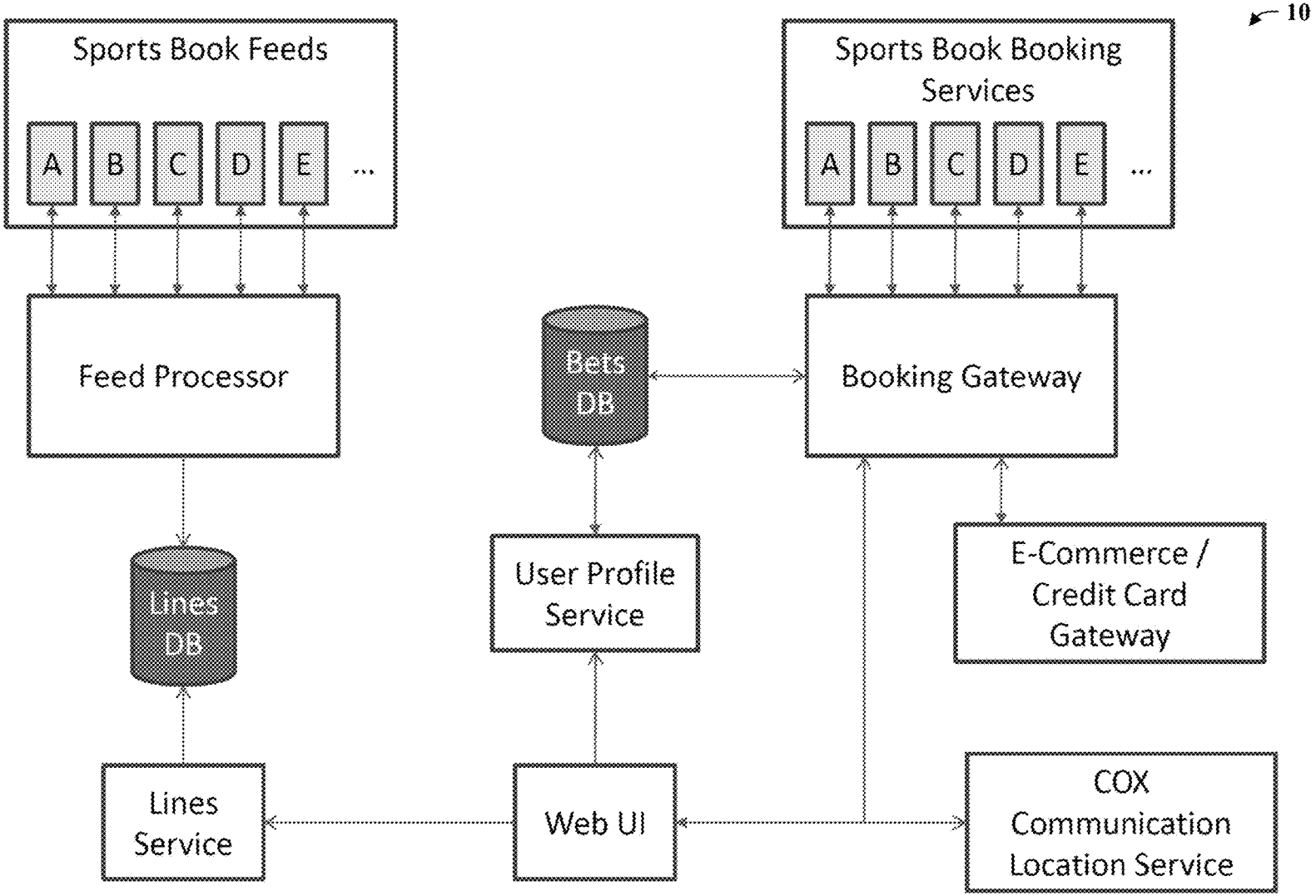
FIG. 3 is a block diagram of the system shown in FIG. 1, according to an embodiment of the present invention.

Referring to FIG. 2, in the illustrated embodiment, the system server 12 includes a system controller 22 that includes a control processing unit (CPU) 24, a database 14, a website module 26, a communications module 28, a user account module 30, a wager selection module 32, a search engine module 34, and a wager placement module 36.

The CPU 24 includes a processor and a memory device and executes various programs, and thereby controls components of the system server 12 according to user instructions received from the mobile computing device 18. The memory device stores various programs and information in the database 14, and retrieves information from the database 14 that is used by the processor to perform various functions described herein.

The database 14 contains information on a variety of matters, such as, for example, user profile accounts, booking entity profile accounts, booking entity information, betting lines, betting line attribute information, search requests, wagering information, web pages, search queries, data records, and/or any suitable information that enables the system 10 to function as described herein. In one embodiment, the database 14 may include a list of betting lines, each betting line including a plurality of betting attributes including at least one of a sport, a team, one or more betting lines.

In one embodiment, the database 14 may store a wagering event data file 42 (shown in FIG. 30) that includes a list of wagering event records 44. Each wagering event record 44 may includes a wagering event ID 46, a receiving book ID 48, and information associated with a wagering event. For example, in one embodiment, a wagering event record 44 may include a wagering event attributes 50 associated with a wagering event and that are associated with a plurality of event categories including, but not limited to, a sporting event, a team, and a betting line. The receiving book ID 48 is associated with a receiving booking entity associated with the wagering event. In one embodiment, the database 14 may also store information necessary to generate a wager verification report 52 (shown in FIGS. 31 and 32) including session IDs, home book IDs, receiving book IDs, and wagering event record 44 and corresponding wager amounts.

In the illustrated embodiment, the database 14 stores a booking record data file 54 (shown in FIG. 28) that includes a plurality of unique booking records 56 that includes information associated with wagers being requested by the system server 12. For example, in one embodiment, each unique booking record 56 may include a unique session ID 58, a unique user ID 60 associated with the user requested the wager, a home book ID 62, a receiving book ID 48, a wagering event ID 46 associated with a wagering event record 44, a wager amount 64 indicating a monetary value of the requested wager, and a verification ID 66.

In the illustrated embodiment, each user has a user wagering account with at least one of the independent wagering entities. The user profile account includes information associated with a corresponding user including information associated with the user wagering account associated with the user and the independent wagering entity associated with the user wagering account. For example, in one embodiment, the user profile account may include data associated with a home booking entity indicating the booking entity server 16 maintaining the corresponding user wagering account. Each booking entity profile account is associated with a corresponding independent wagering entity and includes information associated with the booking entity accounts being held at each of the other independent wagering entities. For example, in one embodiment, the booking entity profile account may include a list of booking entity accounts associated with each of the other independent wagering entities including account information associated with the booking entity profile account. In one embodiment, the database 14 may also include a user profile account data file 68 (shown in FIG. 29) that includes a list of user account records 70. Each user account record 70 includes a unique user ID 60 and a home book ID 62. The home book ID 62 is associated with a home booking entity having a user wagering account associated with a user.

The website module 26 is configured to host a website that is accessible by a user via one or more mobile computing devices 18. The website module 26 retrieves and stores web pages from the database 14 and displays the webpages on the mobile computing devices 18 to allow users to interact with the system 10 to access user account, request betting line information, and place and monitor wagers. In one embodiment, the mobile communication device 18 may include a mobile application that allows the website module 26 to communicate with the mobile computing device 18 to allow the user to operate the system 10 via the mobile communication device 18.

The communications module 28 is configured to communicate and received requests between the system controller 22, the mobile computing devices 18, and each booking entity server 16.

The user account module 30 is configured to access the database 14 to retrieve information associated with user profile accounts being stored in the database and to access user wagering accounts associated with individual users being stored at a corresponding booking entity server 16. For example, in the illustrated embodiment, the user account module 30 may access a user wagering account being stored at a booking entity server 16 associated with a corresponding independent wagering entity to allow the user to request wagers to be placed at various other independent wagering entities on behalf of the user.

The wager selection module 32 is configured to retrieve betting lines associated with live sporting events upon receiving a request from a user, and to display the betting lines on the mobile computing device 18 to allow the user to select one or more betting lines for use in placing a wager. For example, in one embodiment, upon receiving a request from the user to display betting lines, the wager selection module 32 may retrieve a list of betting lines being stored in the database 14 and display the list of betting lines to the user via the mobile computing device 18 to allow the user to select one or more of the displayed betting lines to place a wager.

In one embodiment, the wager selection module 32 may transmit a request for betting line information to each of the booking entity servers 16, receive betting line information from one or more of the booking entity servers 16, and store the received betting line information in the database 14 for use in displaying the betting lines to the user upon receiving a request from the a mobile computing device 18. The wager selection module 32 may periodically transmit requests for betting line information to the booking entity servers 16 on a periodic basis, and/or upon receiving a request for betting line information from a user. In addition, the booking entity servers 16 may transmit betting line information to the system controller 22 for use in displaying the betting line information on the mobile computing device 18 such as, for example, via a "push" notification from the booking entity server 16 to the mobile computing device 18 through the system controller 22 to allow the wagering entities to notify the user of new betting line information and/or updates in betting line information.

In one embodiment, the wager selection module 32 may transmit a request to the search engine module 34 to search the database 14 for betting lines matching search criteria that is received from the user. For example, the database 14 may include a list of betting lines including betting information received from each of the booking entity servers 16. Each of the betting lines may include a plurality of betting attributes such as, for example, a sport, a team, one or more betting lines. The search engine module 34 is configured to receive a betting line search request from the mobile computing device 18 and/or the wager selection module 32 including one or more search terms, and generate search data including a plurality of betting lines as a function of the search terms. For example, in one embodiment, the search engine module 34 may initiate a search algorithm based on a Boolean model to search betting line records contained in the database 14 based search terms received from the user. The search engine module 34 may generate search data including betting lines matching the search criteria and display the retrieved betting lines on the mobile computing device 18.

The wager placement module 36 receives a selection of one or more betting lines from the user via the mobile computing device 18, selects a booking entity server 16 associated with the betting line, generates a wager request as a function of the selected betting lines, and transmits the wager request to the selected booking entity server 16 to use in placing the wager on behalf of the user. In one embodiment, the wager placement module 36 is configured to generate a unique booking record 56 including a unique session ID 58 upon receiving a request from a user to place a wager on a wagering event, and store the unique booking record 56 in the database 14. The wager placement module 36 may also be configured to determine a home book ID included in a user account record associated with the user and modify the unique booking record to include the home book ID. The wager placement module 36 may also receive a selection of a wagering event from the user, identify the receiving book ID included in the wagering event record associated with the selected wagering event and modify the unique booking record to include the identified receiving book ID and the wagering event record. The wager placement module 36 may also be programmed to generate and transmit a signal to a middleware server 15 including the unique booking record and a request to place a wager associated with the selected wagering event. The middleware server 15 identifies the home booking entity and the receiving booking entity associated with the request unique booking record and processes the wager between the home booking entity and the receiving booking entity.

Figure 22:
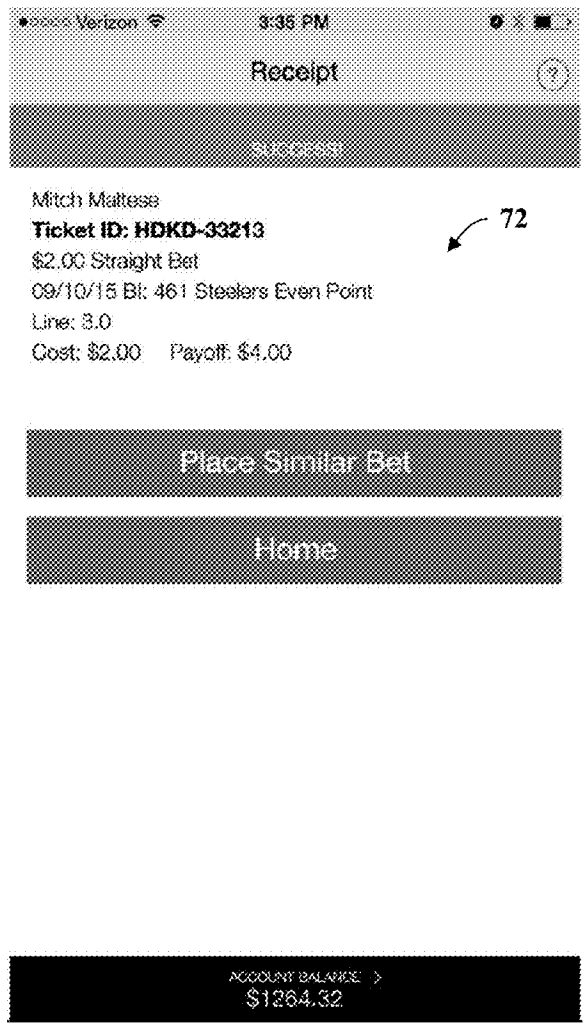
Figure 24:
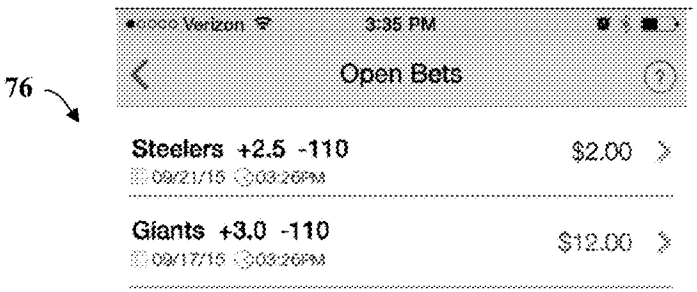
Figure 24:
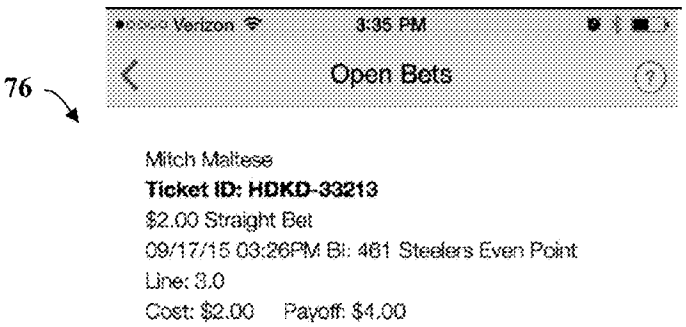
Figure 24:
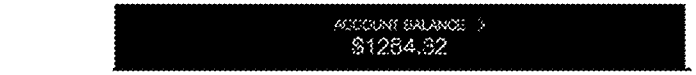
Figure 25:
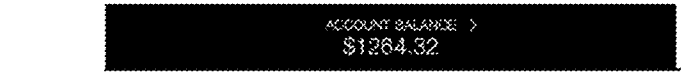
Figure 26:
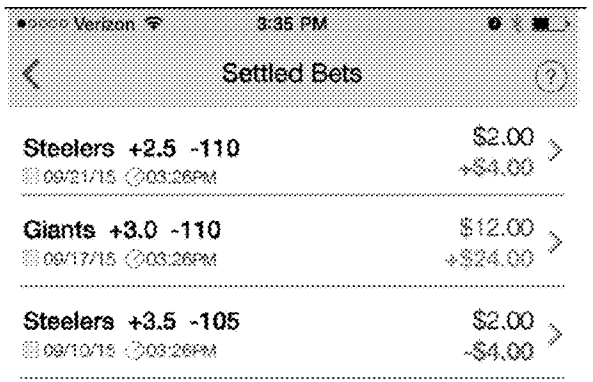
Figure 27:
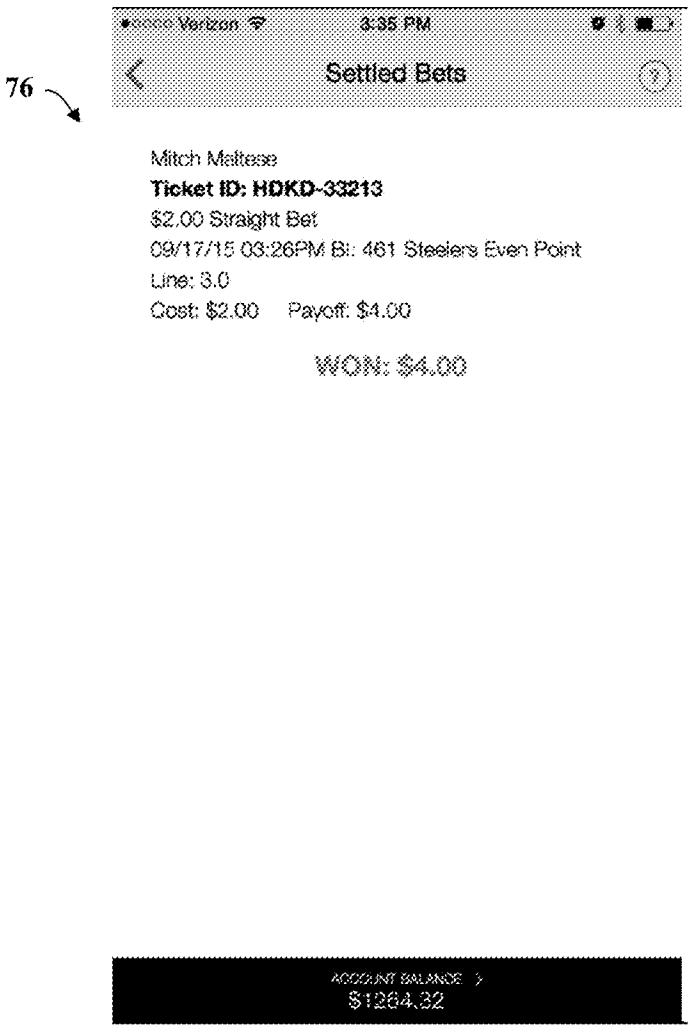

In one embodiment, wager placement module 36 is also programmed to request and receive a verification signal from the middleware server 15 including a verification ID indicating the wager has been processed and modify the unique booking record to include the verification ID. The wager placement module 36 may also generate a wager verification report 52 (shown in FIGS. 31 and 32) including the session ID 58, the home book ID 62, the receiving book ID 48, the selected wagering event record 44, and the wager amount 64, and store the wager verification report 52 in the database and display a verification notification 72 (shown in FIG. 22) to the mobile computing device 18 to notify the user that the wager has been placed.

Figure 14:
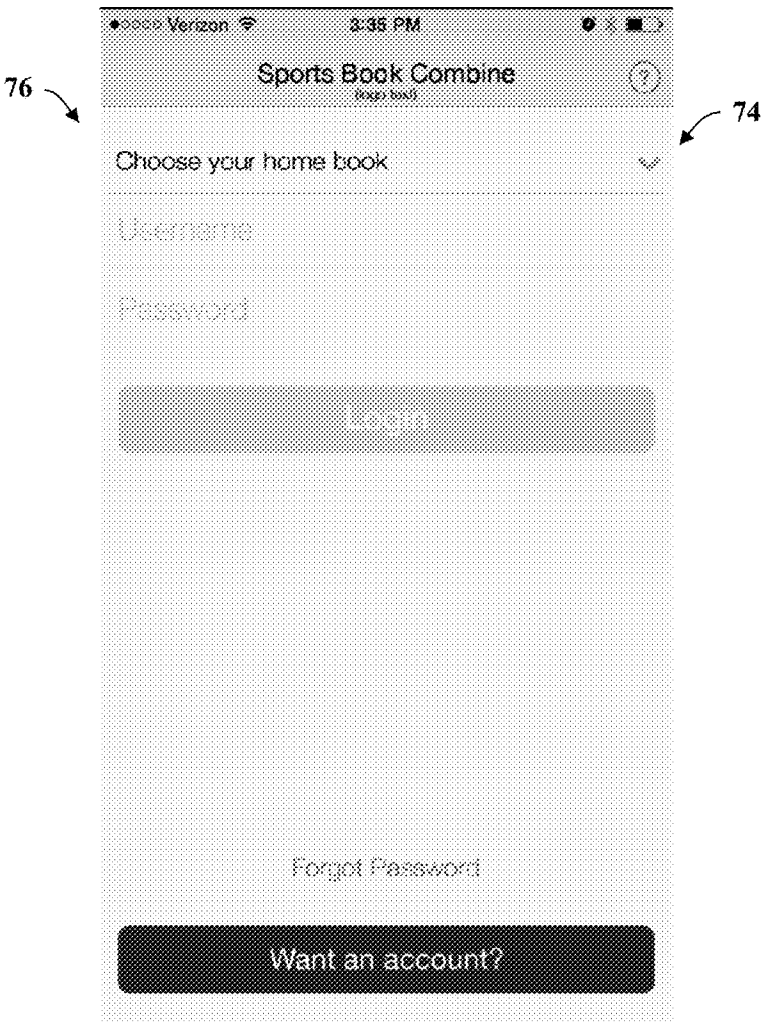
Figure 17:
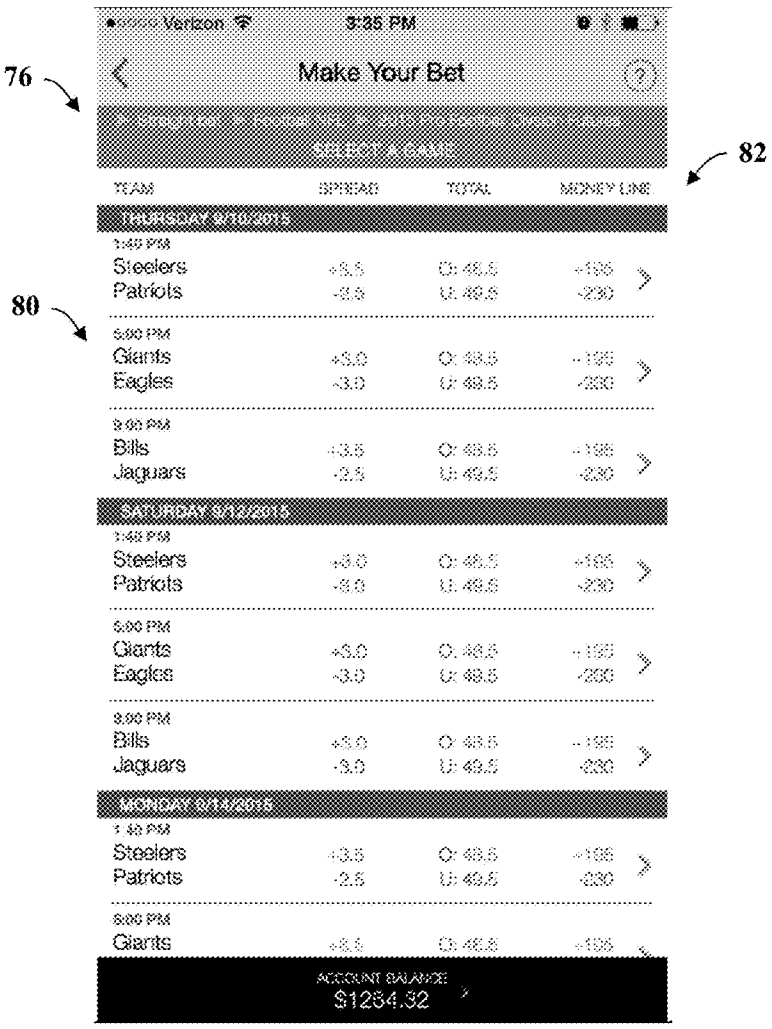
Figure 16:
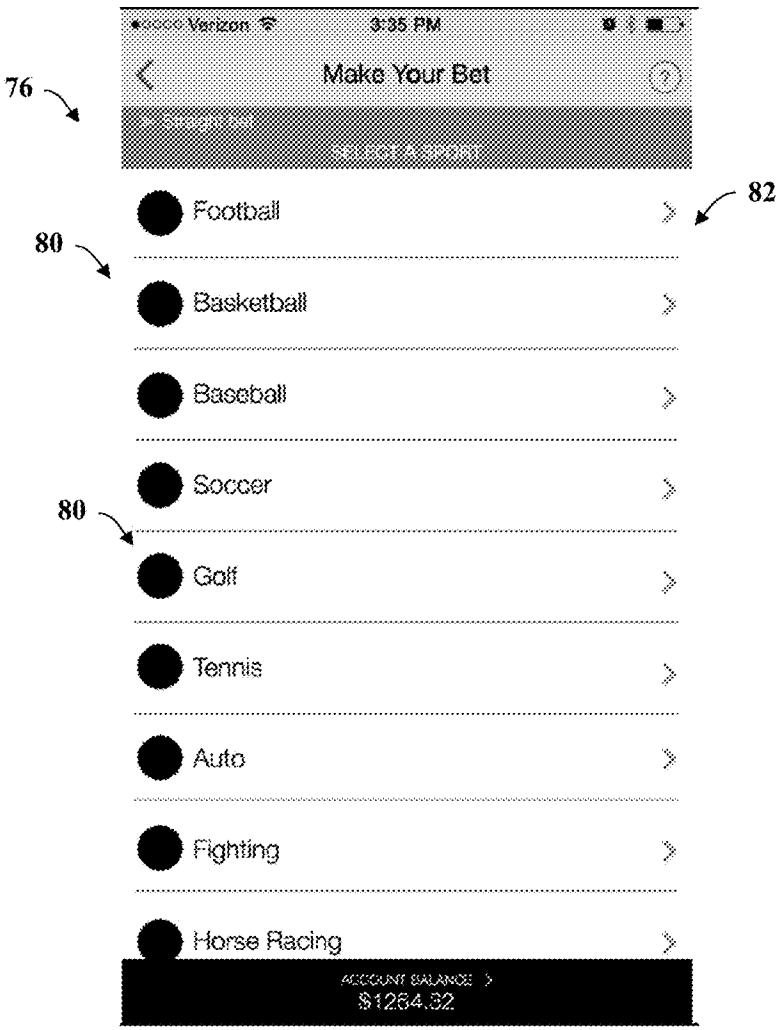
Figure 19:
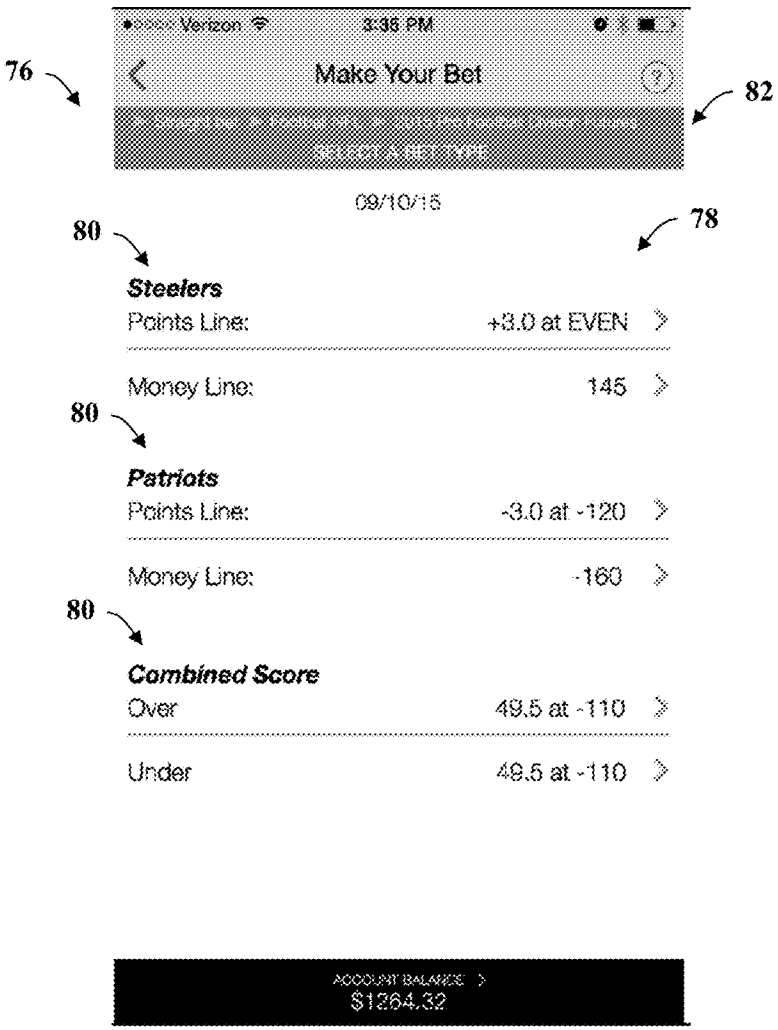
Figure 18:
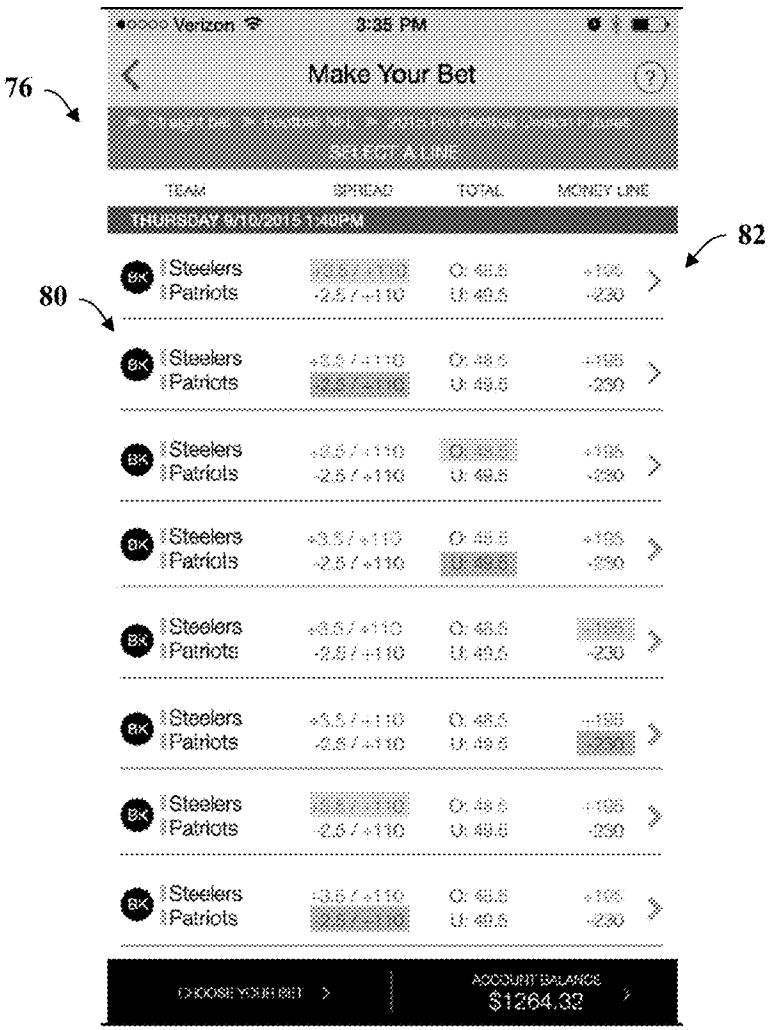

In the illustrated embodiment, during operation of the system 10, the system controller 22 displays a login webpage 74 (shown in FIG. 14) to allow a user to access the system and receives a unique user identification associated with the user from the mobile computing device 18. Upon receipt of the user identification, the system controller 22 accesses the user profile list being stored in the database 14, determines a user account associated with the unique user ID, and determines a home booking entity 38 associated with the user account. The home booking entity 38 stores a user wagering account that is associated with the user.

The system controller 22 receives a request to display betting lines associated with live sporting events from the user via the mobile computing device 18. The request may include one or more betting line attributes that allows the system controller 22 to search the betting lines being stored in the database 14 to retrieve betting lines matching the user request. The system controller 22 generates search criteria based on the received request, accesses the database to retrieve betting lines having betting line attributed matching the requesting betting line attributes, and displays the retrieved betting lines on the mobile computing device 18. In one embodiment, the system controller 22 searches betting lines previously stored in the database 14. The system controller 22 may also transmit a betting line request to receive betting line data to each booking entity server 16 upon receiving the request from the user. In one embodiment, the betting line request may include the search criteria generated by the system controller 22.

In one embodiment, the system controller 22 may determine a relevancy score associated with each retrieved betting line. The relevancy score may be based on the number of betting line attributes matching the search criteria. In addition, the system controller 22 may generate a ranked list of betting lines based on the corresponding relevancy scores of each betting line. In addition, the system controller 22 may identify one or more betting lines having a relevancy score that is equal to or greater than a predefined relevancy score and display a notification to the user indicating the identified betting lines. For example, the system controller 22 may highlight the identified betting lines on the mobile computing device and designate the identified betting lines as a "Best Bet" to the user.

In the illustrated embodiment, the system controller 22 retrieves the betting lines matching the user request and displays the retrieved betting lines on the mobile computing device 18. Each betting line includes a corresponding independent wagering entity that is associated with the corresponding betting line. The system controller 22 receives a selection of a betting line from the user via the mobile computing device 18 and receives a wager request associated with the selected betting line including a bet amount. Upon receiving the wager request, the system controller 22 transmits a request to the home booking entity 38 to adjust a credit balance of the corresponding user wagering account as a function of the wager request.

In the illustrated embodiment, the system controller 22 determines a receiving booking entity 40 that is associated with the selected betting line. The receiving booking entity 40 is the independent wagering entity that established the selected betting line and is available to receive wagers on the selected betting line. The system controller 22 then access the booking entity profile account associated with the home booking entity 38, identifies the receiving booking entity 40 associated with the selected betting lines, and determines a home booking betting account associated with the home booking entity and being maintained at the receiving booking entity 40. The system controller 22 then determines a home booking entity account identifier associated with home booking entity betting account and transmits a bet request to the receiving booking entity 40 including the home booking entity account information and the wager request to facilitate the receiving booking entity to place the requested wager using the home booting entity account. The system controller 22 then receives a verification notice indicating that the requested wager has been placed by the receiving booking entity. Upon the conclusion of the sporting event associated with the wager, the system controller 22 receives a notification of the outcome of the wager, and displays the outcome to the user via the mobile computing device 18. The system controller 22 also transmits a request to the home booking entity 38 to adjust a credit balance of the user wagering account as a function of the outcome of the wager.

Figure 4:
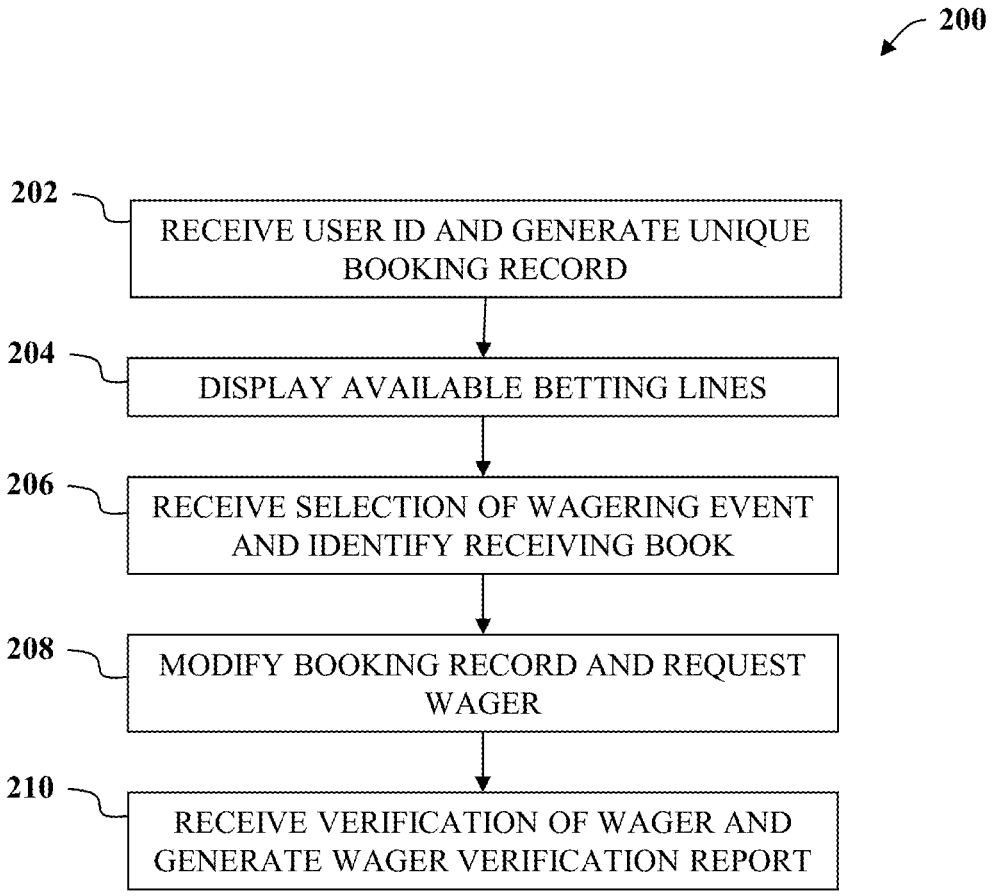
FIGS. 4-13 are flowcharts of methods that may be used with the system shown in FIGS. 1-3, according to an embodiment of the present invention.
Figure 5A:
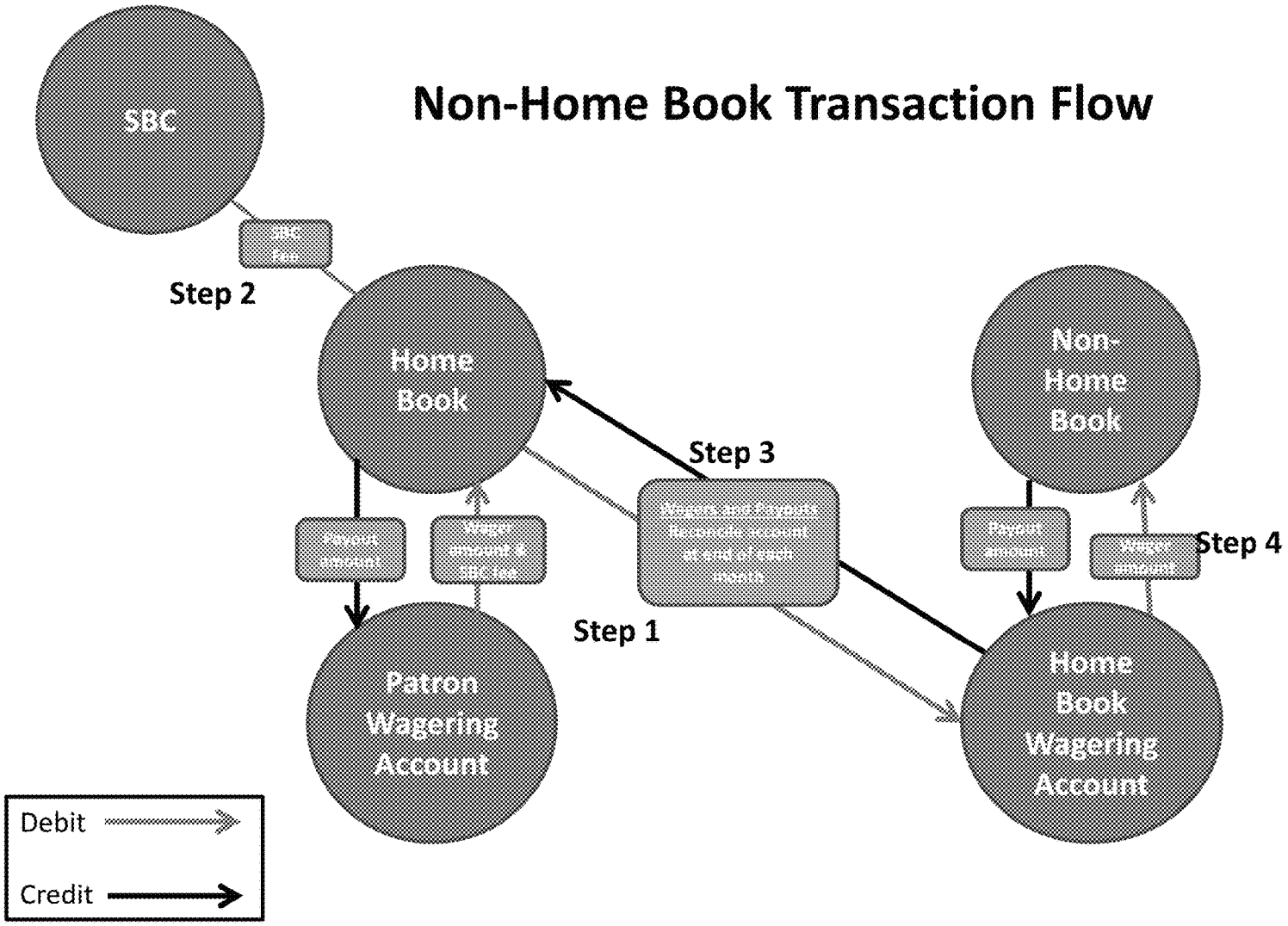
Figure 5B:
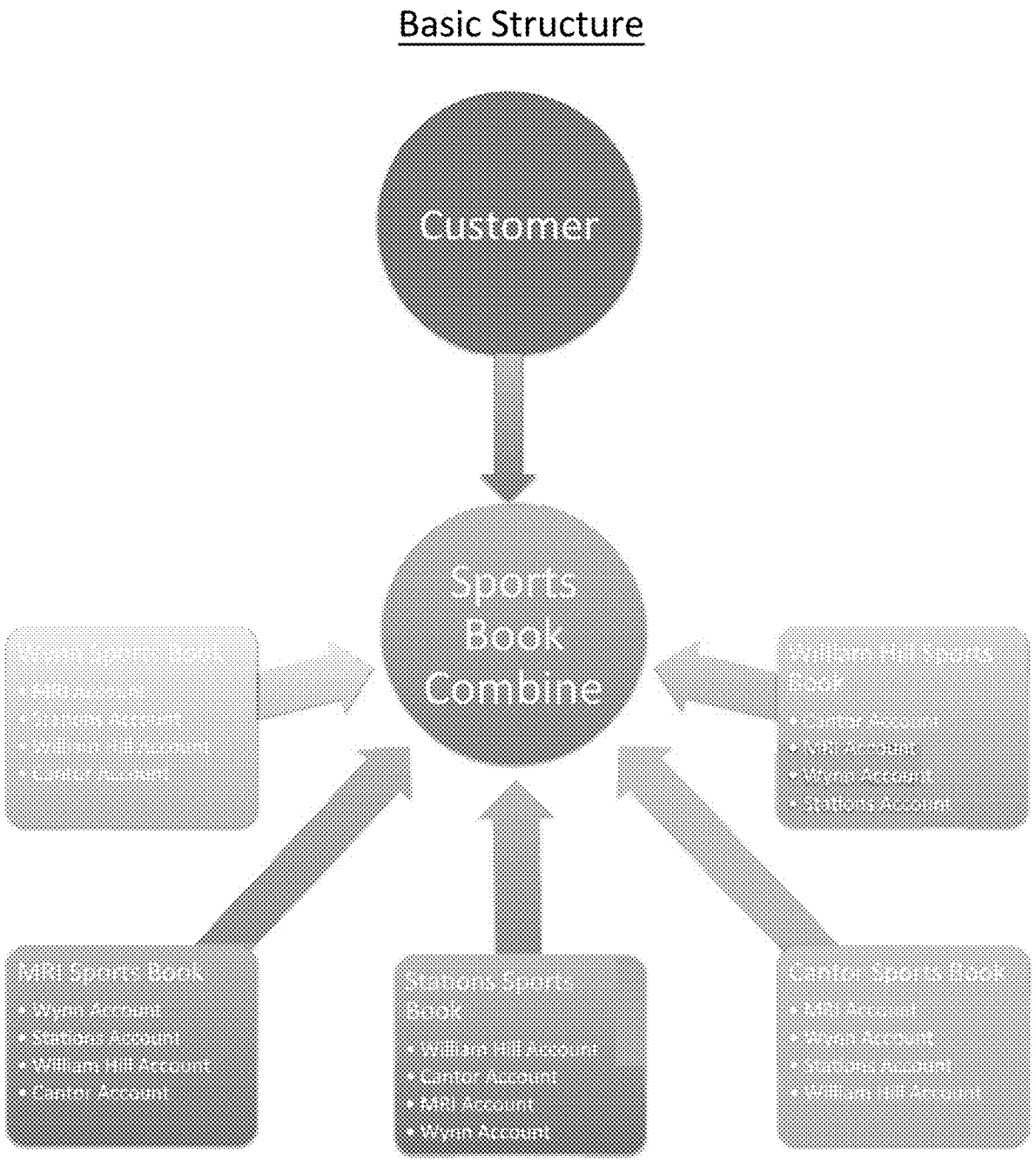
Figure 6:
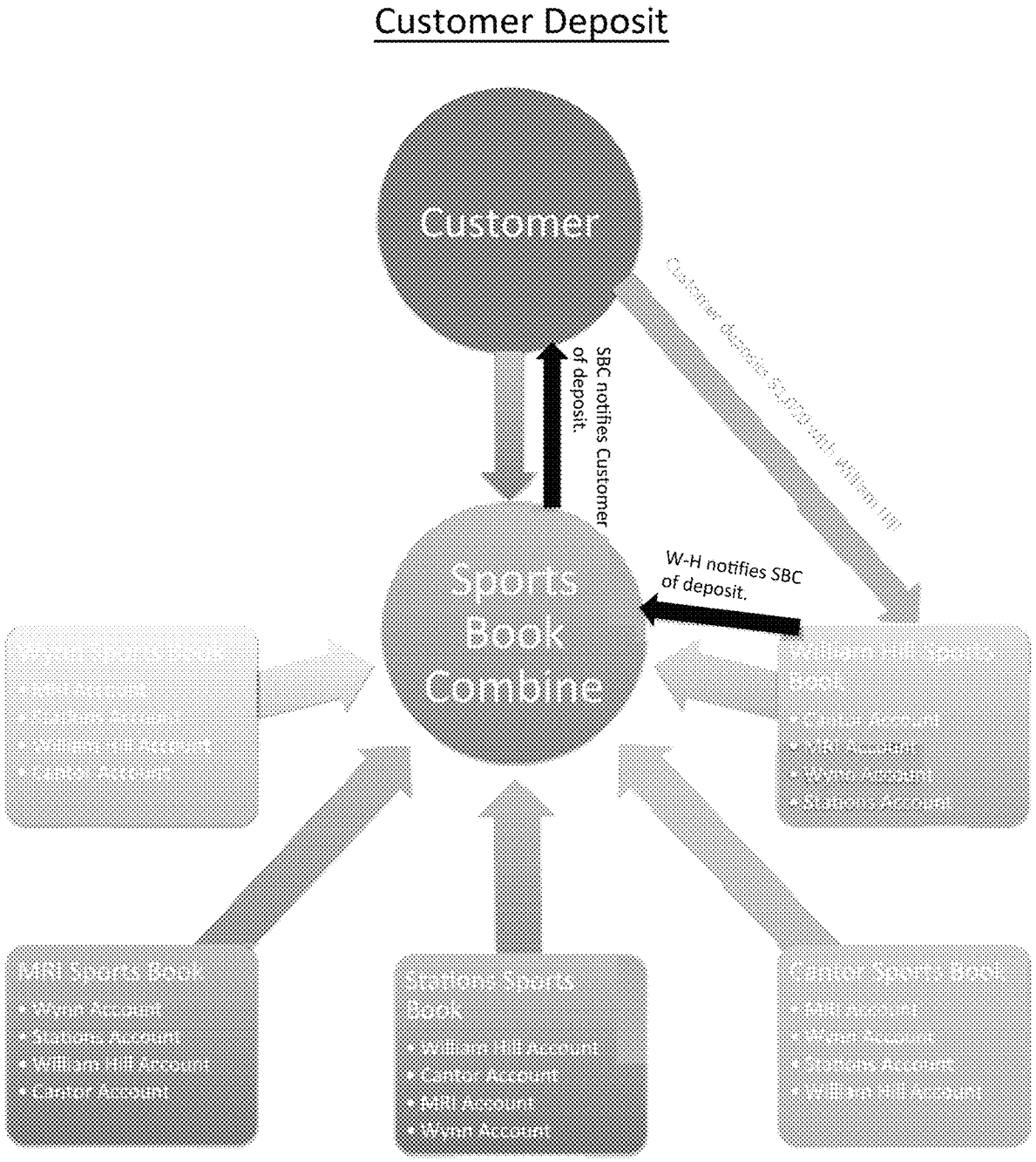
Figure 7:
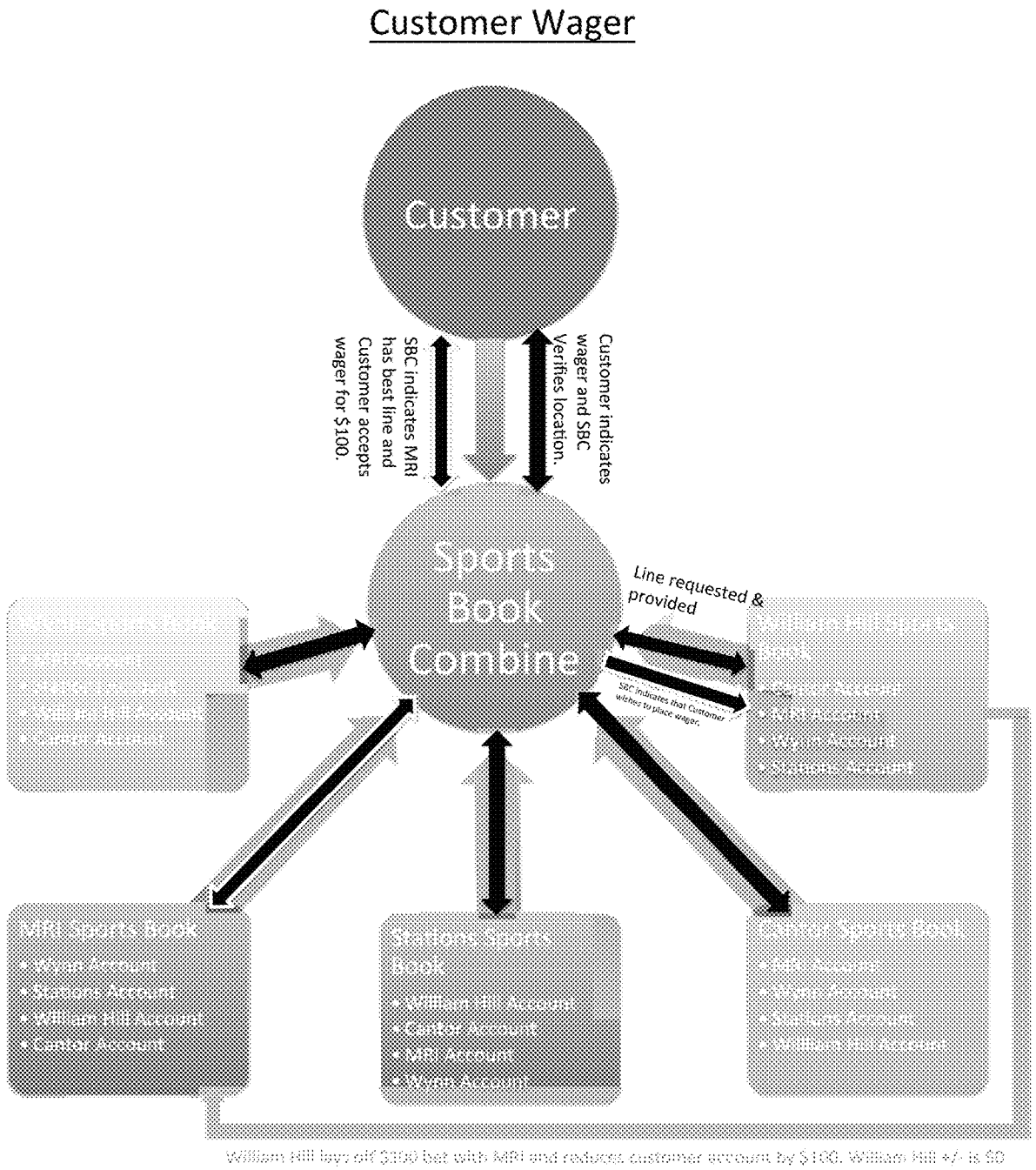
Figure 8:
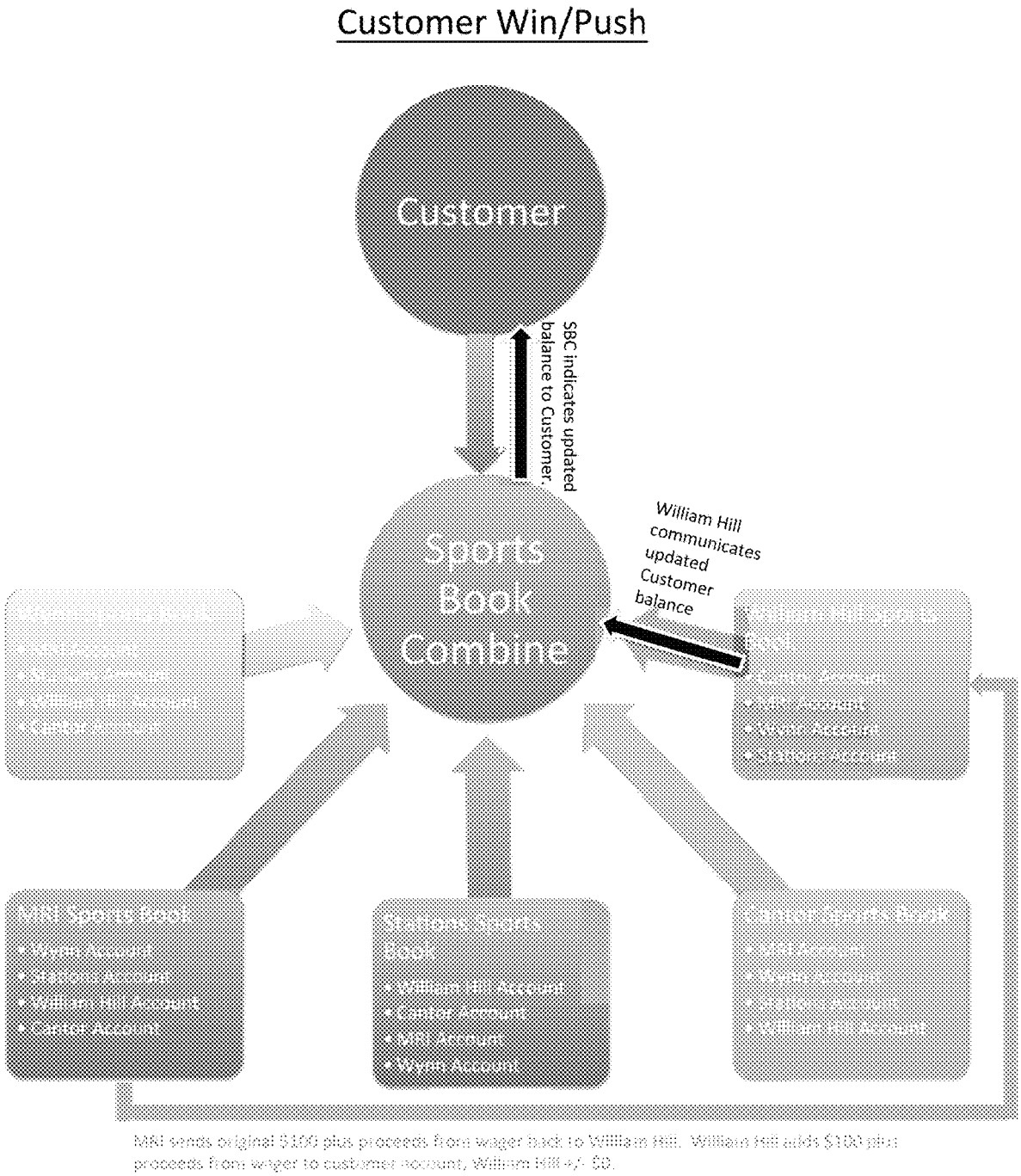
Figure 9:
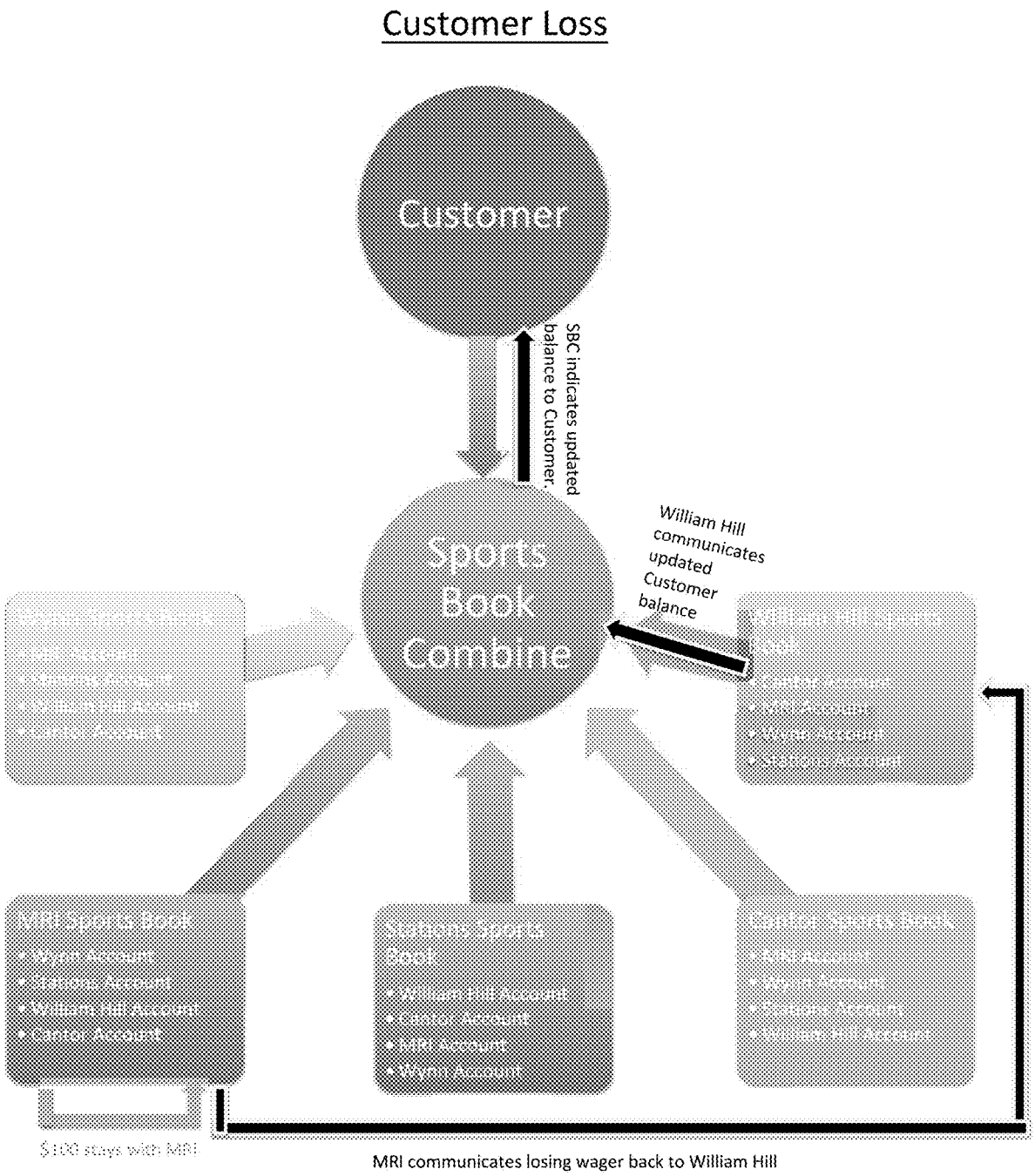

FIG. 4 is a flowchart of a method 200 that may be used to operate the system 10. FIGS. 10-13 are flowcharts of additional methods 300, 400, 500, 600, that may be used to operate the system 10. The illustrated methods include a plurality of steps. Each method step may be performed independently of, or in combination with, other method steps. Portions of the methods may be performed by any one of, or any combination of, the components of the system 10. FIGS. 14-27 are exemplary entertaining graphical displays that may be displayed on the mobile computing devices 18 to enable users to operate the system 10.

Referring to FIG. 4, in method step 202, the system controller 22 receives a unique user ID from a mobile computing device 18 and generates a unique booking record 56 (shown in FIG. 28) including a unique session ID and stores the unique booking record in the database 14. For example, in one embodiment, the system controller 22 is configured to install an application program on a mobile computing device 18 that includes a processor, a memory device, and a touchscreen. The memory device having the application program stored therein that, when executed, causes the processor of the mobile computing device to display a graphical user interface 76 (shown in FIGS. 14-27) via the touchscreen. In one embodiment, the application program causes the mobile computing device 18 to display a login screen 74 (shown in FIG. 14) and prompts the user to enter a unique user ID.

In the illustrated embodiment, the system server 12 receives, from the mobile computing device, the unique user ID 60 associated with the user and accesses the database 14 and identifies a user account record 70 (shown in FIG. 29) associated with the unique user ID. The system server 12 then generates the unique booking record 56 including a unique session ID and stores the unique booking record in the database 14. In addition, the system server 12 determines a home book ID 62 included in the selected user account record 70 and modifies the unique booking record 56 to include the home book ID 62.

In method step 204, the system server 12 displays a plurality of wagering events on the mobile computing device and allows the user to select one or more wagering events to place a wager. For example, in one embodiment, the system server 12 may access the list of wagering events records 44 being stored in the database 14 and display a wagering screen 78 (shown in FIG. 19) including a plurality of wagering event selectors 80 on the graphical user interface of the mobile computing device 18. Each wagering event selector 80 is selectable by the user via the touchscreen and indicates a wagering event associated with a corresponding wagering event record 44. Each wagering event selector 80 may also display the betting line included in the corresponding wagering event records 44.

In one embodiment, the system server 12 may access the database 14 to retrieve the wagering event records 44 including the event attributes associated with a plurality of event categories including a sporting event, a team, and a betting line. The system server 12 then displays a selection screen 82 (shown in FIGS. 15-18) on the mobile computing device including the plurality of event categories to allow the use to operate the system server 12 to search the wagering event records 44. The system server 12 may then receive a user selection of an event category of the plurality of event categories, display the selection screen including event attributes associated with the selected event category, receive a signal indicating a user selected event attribute, and select wagering records having event attributes matching the user selected event attribute and display the wagering screen including wagering event selectors corresponding to the selected wagering records on the mobile computing device. For example, in one embodiment, the system server 12 may receive, from the mobile computing device, a request to display betting lines including one or more betting line attributes, access the database to retrieve wagering event records having betting line attributes matching the requesting betting line attributes, and display the wagering event selectors including the retrieved betting lines.

Figure 20:
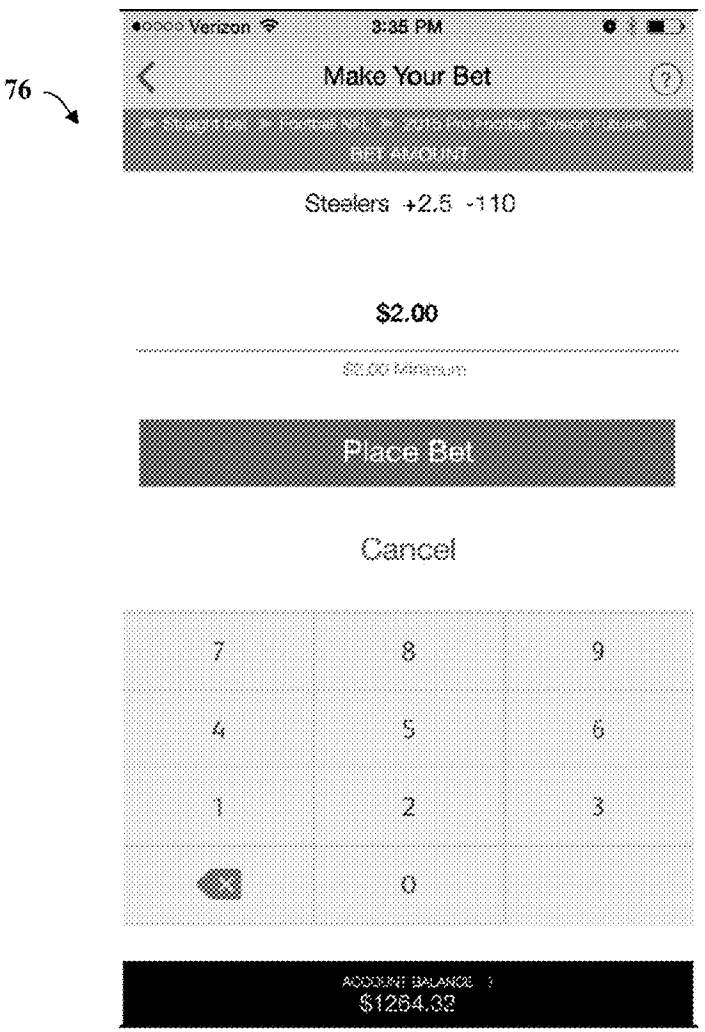
Figure 21:
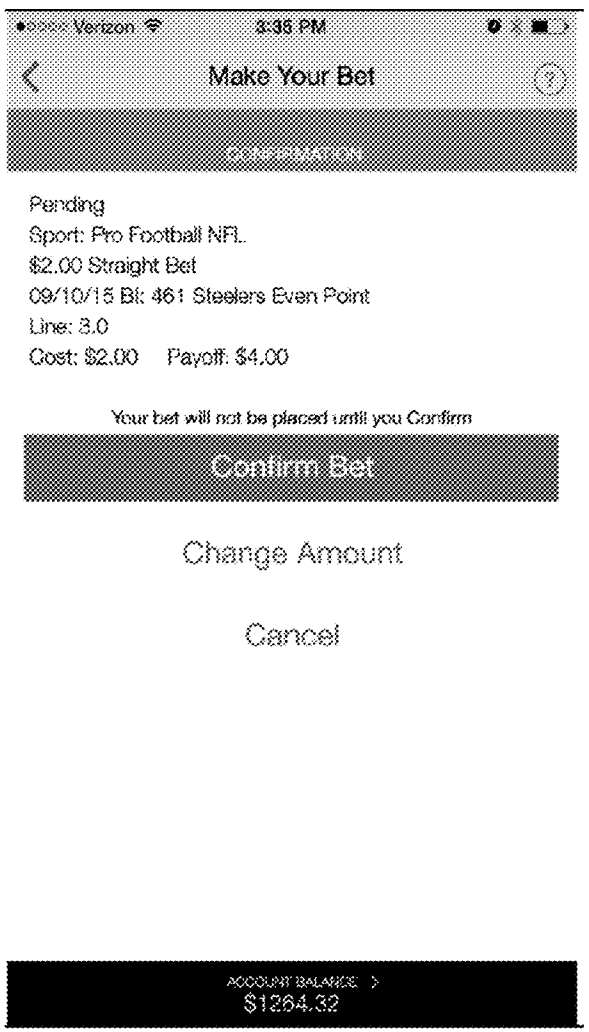
Figure 23:
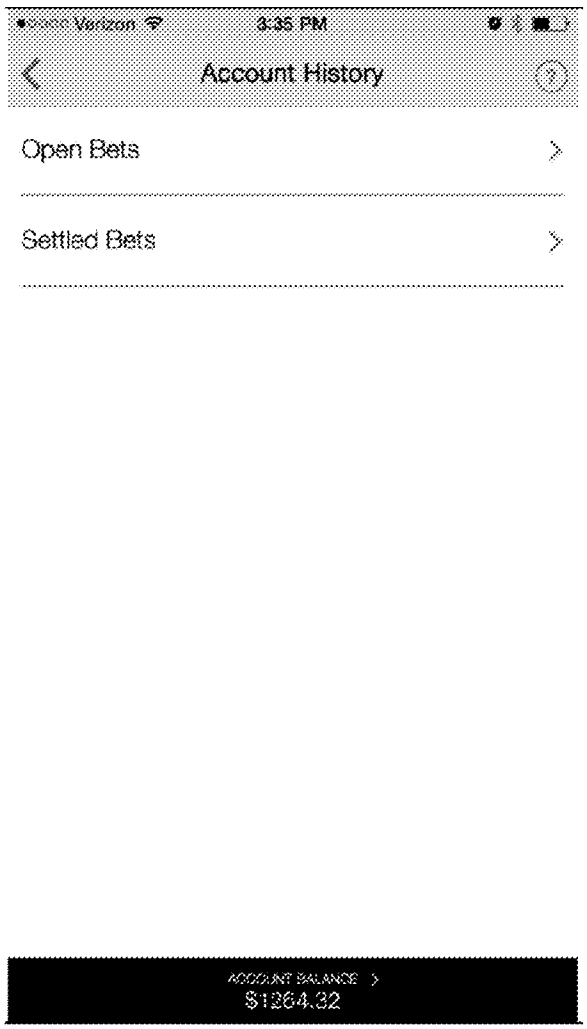

In method step 206, the system server 12 receives a selection of a wagering event by the user and identifies a receiving booking entity associated with the selected wagering event. For example, in one embodiment, the system server 12 receives a signal from the mobile computing device including a selection of a wagering event from the user via the touchscreen and prompts the user to enter a wager amount (as shown in FIG. 20). Upon receiving the wager amount, the system server 12 accesses the database 14 to identify the wagering event record 44 associated with the user selected wagering event and identifies the receiving book ID included in the identified wagering event record 44.

In method step 208, the system server 12 modifies the unique booking record 56 to include the identified receiving book ID 48 and the wagering event ID 46 associated with the selected wagering event record 44. The system server 12 also generates and transmits a signal to a middleware server 15 including the unique booking record 56 and a request to place a wager associated with the selected wagering event. The middleware server 15 then identifies the home booking entity and the receiving booking entity associated with the request based on the home book ID and the receiving book ID included in the unique booking record 56 and processes the wager between the home booking entity and the receiving booking entity.

In one embodiment, the system server 12 may be configured to transmit a betting line verification request to the receiving booking entity server 40 to verify information included in the user selected wagering event record 44, and transmit the unique booking record 56 to the middleware server 15 upon receiving a verification response validating the information in the user selected wagering event record from the receiving booking entity.

The system server 12 may also receive a non-verification response from the receiving booking entity that the user selected wagering event record is not valid and display a notification to the user that the selected wagering event is not available to place a wager. In addition, the system server 12 may be configured to delete the unique booking record 56 from the database 14 upon receiving the non-verification response.

In method step 210, the system server 12 receives a verification signal from the middleware server 15 indicating that the wager has been placed and transmits and displays a verification notification 72 (shown in FIG. 22) on the mobile computing device 18 to notify the user that the wager has been placed.

In one embodiment, the system server 12 may receive a verification signal from the middleware server 15 including a verification ID 66 indicating the wager has been processed and modify the unique booking record to include the verification ID 66. The system server 12 may also generate a wager verification report 52 (shown in FIGS. 31-32) including the session ID, the home book ID, the receiving book ID, the selected wagering event record, and the wager amount, and store the wager verification report in the database 14.

The system server 12 may also receive a signal from the middleware server 15 including a session ID and an outcome of a wagering event and access the database 14 and identify a wagering event record 44 having a session ID matching the received session ID and update the identified wagering event record 44 to include the outcome of the wagering event. The system server 12 may also transmit a notification to the mobile computing device 18 to notify the user of the outcome of the identified wagering event.

The Sports Book Combine (SBC) system 10 consists of a set of server based processes accessed via RESTful APIs and one or more user facing clients developed for Mobile platforms.

In one embodiment, the following conditions are assumed to be in effect for SBC operation: 1) The user has previously opened an account with a sports book participating in the SBC system and received login credentials. This is the user's "home book". 2) The user will authenticate to SBC server 12 by selecting the home book and using the login credentials from the home book.

Figure 10:
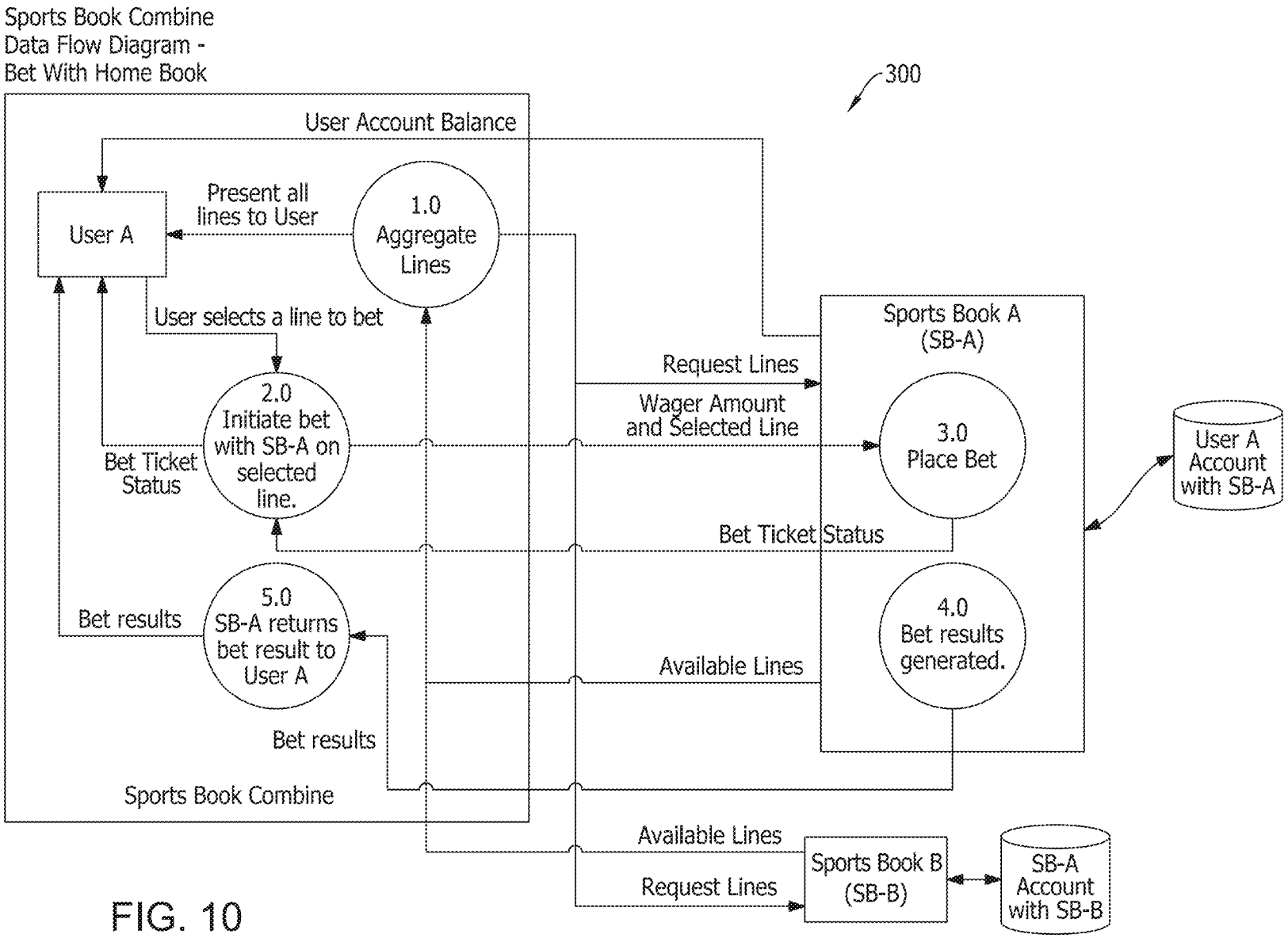

With reference to FIG. 10, in one embodiment, the system 10 may implement method 300. In method 300, Bet With Home Book: SBC Process 1.0 Line Aggregation: This process is continually running on the SBC server 12 to compile all the lines being offered by the participating sports books. There is a RESTful API to this process for a client app to request the aggregated lines. This process can operate two ways. 1) Continual Aggregation: In this mode, the process will request lines from the participating sports books on periodic intervals and cache the listings. When the SBC client application executed on the mobile computing device 18 requests the aggregated lines, the cached list will be returned. This mode offers the best real time performance to the clients at the cost of not presenting the latest lines available. 2) Aggregation on demand: In this mode, the process will request lines from the participating sports books when the SBC client application issues a request for the aggregated lines. This mode will offer the latest lines available from the participating books at the cost of real time performance.

SBC Process 2.0 Initiate Bet with Home Book: The user selects a line from their home book and determines a bet amount. The client application calls a RESTful API provided by the SBC server 12 identifying the line, the user's home book, and the user's credentials. The SBC server 12 then initiates the bet with the home book. When the home book returns the status of the bet ticket, that status is displayed to the end user.

SBC Process 3.0 Place Bet: The sports book places the bet for the amount chosen on the line selected by the user. The status of the bet ticket is returned to the SBC server 12. SBC Process 4.0 Bet Results Generated: After the event a bet is placed on is concluded, the sports book returns the results to the SBC server 12.

SBC Process 5.0 Return Results to User: Upon receiving the bet results from the sports book, this SBC process will notify the user that a result is available via push notification. Upon launch, the client app will request the bet results from this SBC process.

Figure 11:
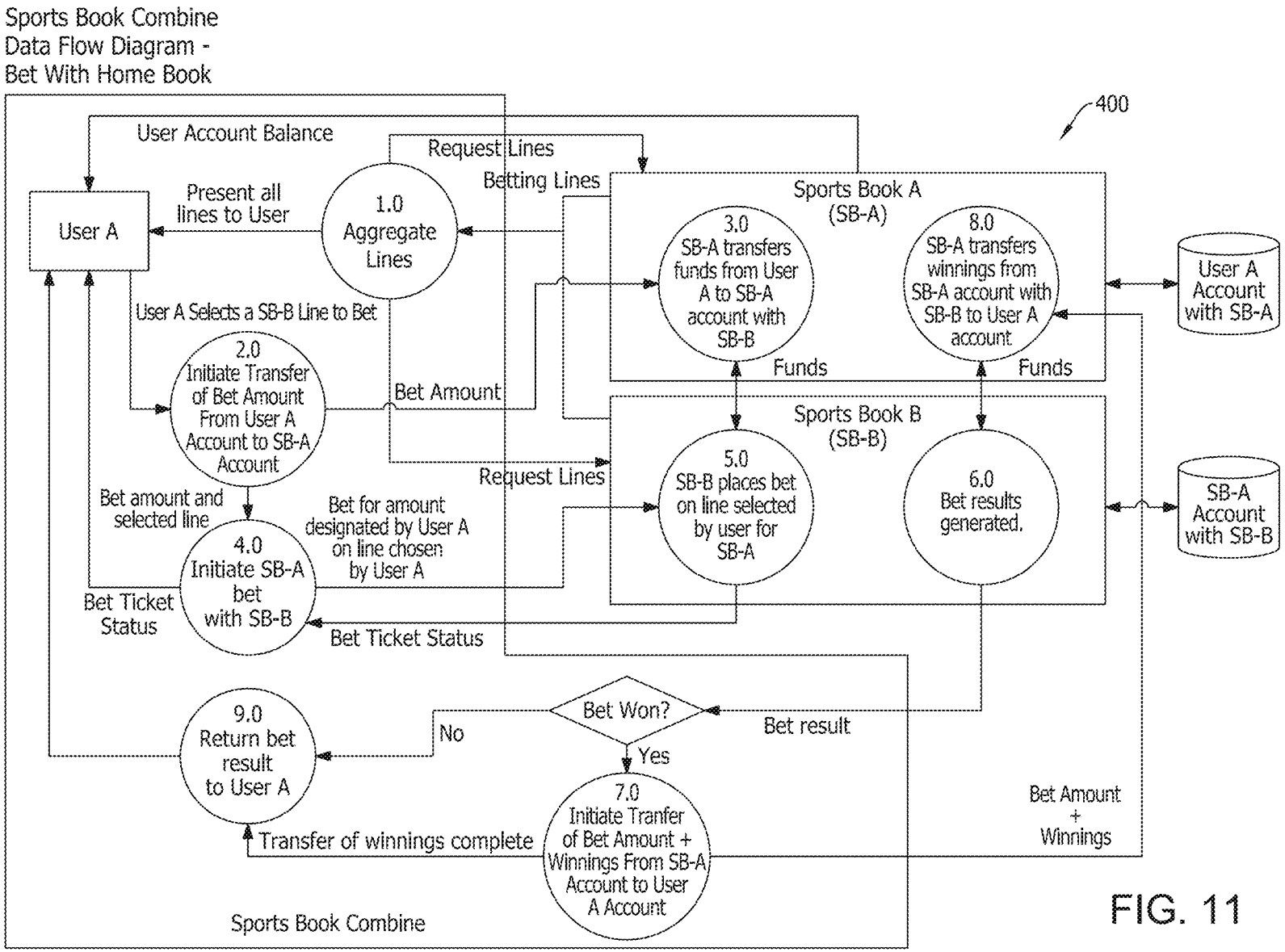

With reference to FIG. 11, in one embodiment, the system 10 may implement method 400. In method 400, Bet with Other Book: the system 10 allows the user to chose a line offered by a sports book other than the user's home book. The User's Home Book is designated Sports Book A (SB-A) and the other book involved in the bet is called Sports Book B (SB-B).

SBC Process 1.0 Aggregate Lines: This process is continually running on the SBC server 12 to compile all the lines being offered by the participating sports books. There shall be a RESTful API to this process for a client app to request the aggregated lines. This process can operate two ways: 1) Continual Aggregation: In this mode, the process will request lines from the participating sports books on periodic intervals and cache the listings. When the SBC client application requests the aggregated lines, the cached list will be returned. This mode offers the best real time performance to the clients at the cost of not presenting the latest lines available. 2) Aggregation on demand: In this mode, the process will request lines from the participating sports books when the SBC client application issues a request for the aggregated lines. This mode will offer the latest lines available from the participating books at the cost of real time performance.

SBC Process 2.0 Initiate Transfer of Bet Amount: The user selects a line from another book and determines a bet amount. The client application calls a RESTful API provided by the SBC server 12 identifying the line, the user's home book, and the user's credentials. The SBC servers 12 instruct SB-A to transfer funds in the requested bet amount from the user's account to SB-A's account with SB-B.

SBC Process 3.0 Transfer Bet Amount: SB-A transfers the funds in the requested bet amount from User A's account to SB-A's account with SB-B.

SBC Process 4.0 Initiate Bet with Other Sports Book: the SBC server 12 initiates the bet as SB-A with SB-B for the bet amount, on the line selected by the user.

SBC Process 5.0 Place bet: SB-B places the bet for SB-A on the line chosen by the user and generates the bet ticket. The status of the bet ticket is returned to the SBC server 12 and reported to the end user.

SBC Process 6.0 Bet Results Generated: After the event the bet is placed on is concluded, the sports book returns the result to the SBC server 12.

SBC Process 7.0 Initiate Winnings Transfer: If the bet was won, the SBC server 12 notifies SB-A to transfer the winnings and the initial bet amount from SB-A's account with SB-B into User A's account with SB-A on a win. If the bet was tied, the SBC server 12 notifies SB-A to transfer the initial bet amount from SB-A's account with SB-B into User A's account with SB-A.

SBC Process 8.0 SB-A Transfers the Funds: SB-A transfers the funds from SB-A's account with SB-B to User A's account.

SBC Process 9.0 Return Results to User: This SBC process will notify the user that a result is available via push notification. Upon launch, the client app will request the bet results from this SBC process.

"Choose your Line" This similar to a buy order on a stock exchange. For example, in one embodiment, a customer may want a game at a −2.5 and there are no lines better than −3. Then this customer has the opportunity to put in a buy order so if any line at any network sports book drops to −2.5 then their bet may be placed automatically and the customer is notified. The SBC server 12 will track and aggregate these "buy orders" and notify partner sports books within the network so they can know in advance how many bets may be placed if they move their line.

In one embodiment, the system 10 may be configured to allow the patron to download the SBC mobile software application (SBC Application) to the mobile computing device 18 and login by selecting their user home book ("Home Book") and entering their existing login credentials for their Home Book. For instance, if the patron has an account with Boyd, the patron would identify Boyd as their Home Book, enter their login information, and the SBC Application would link to their Boyd account.

Once logged into the SBC Application, the patron can view the lines for select events offered by licensed Nevada sports books within the SBC network ("Network Books"), and the patron can choose their preferred line. For example, if the patron is located in Nevada and wants to wager on an NFL game, they can login to the SBC Application, view all the lines the Network Books are offering on that game, select their preferred line, and then make a wager.

If the patron selects a line offered by their Home Book, the Home Book will accept the wager and debit the patron's account. The Home Book will confirm the wager with the patron using the SBC Application. If the patron wins the wager, the Home Book will credit the patron's account.

If the patron selects a line offered by a Network Book that is not their Home Book (a "Non-Home Book"), the Home Book will serve as an agent for the patron by placing the wager with the Non-Home Book on behalf of the patron. Specifically, the Home Book will withdraw the amount wagered from the patron's Home Book account, deposit the funds into the Home Book's wagering account with the Non-Home Book, and place a wager with the Non-Home Book on behalf of the patron. Once the wager is made, the Home Book will confirm the wager with the patron using the SBC Application. If the wager is a winning wager, the patron's Home Book account will be credited with the winnings by reversing the transaction detailed above, namely the Non-Home Book will deposit the winnings into the Home Book's account, which in turn will deposit the winnings into the patron's Home Book account.

Each time a patron logs into the SBC Application, a Unique Session ID (a "SID") will be created that records the patron's activities for that session, including all transactional data (withdrawals, deposits, the time a wager is placed, the ticket ID, the wager type, the amount, the line/odds, and the potential winning amount). The SID will allow the SBC server 12 to trace the wagering activity and, among other things, identify the Network Book where the wager was ultimately placed. Additionally, if a Non-Home Book has reason to believe that suspicious wagering is taking place, it can use the SID to contact the Home Book and enquire into the identity of the patron for purposes of its anti-money laundering program.

If a patron wagers with their Home Book, the Home Book's house rules will govern the wager, including any disputes. If a patron wagers with a Non-Home Book (using their Home Book as an agent), the Non-Home Book's house rules will govern the wager, including any disputes. The SBC Application will provide the patron access to the house rules of every Network Book stored in the database and the patron will be required to acknowledge that their wagers are bound by the house rules of the Network Book they select to wager with as part of the SBC Application's terms and conditions.

SBC system 10 will deduct from the patron account a fixed transaction fee per wager. This transaction fee will be debited from the patron's Home Book account.

The SBC Application will also display wagering opportunities for all Network Books and track patron activity, but will not hold deposits or pay wagers.

Figure 12:
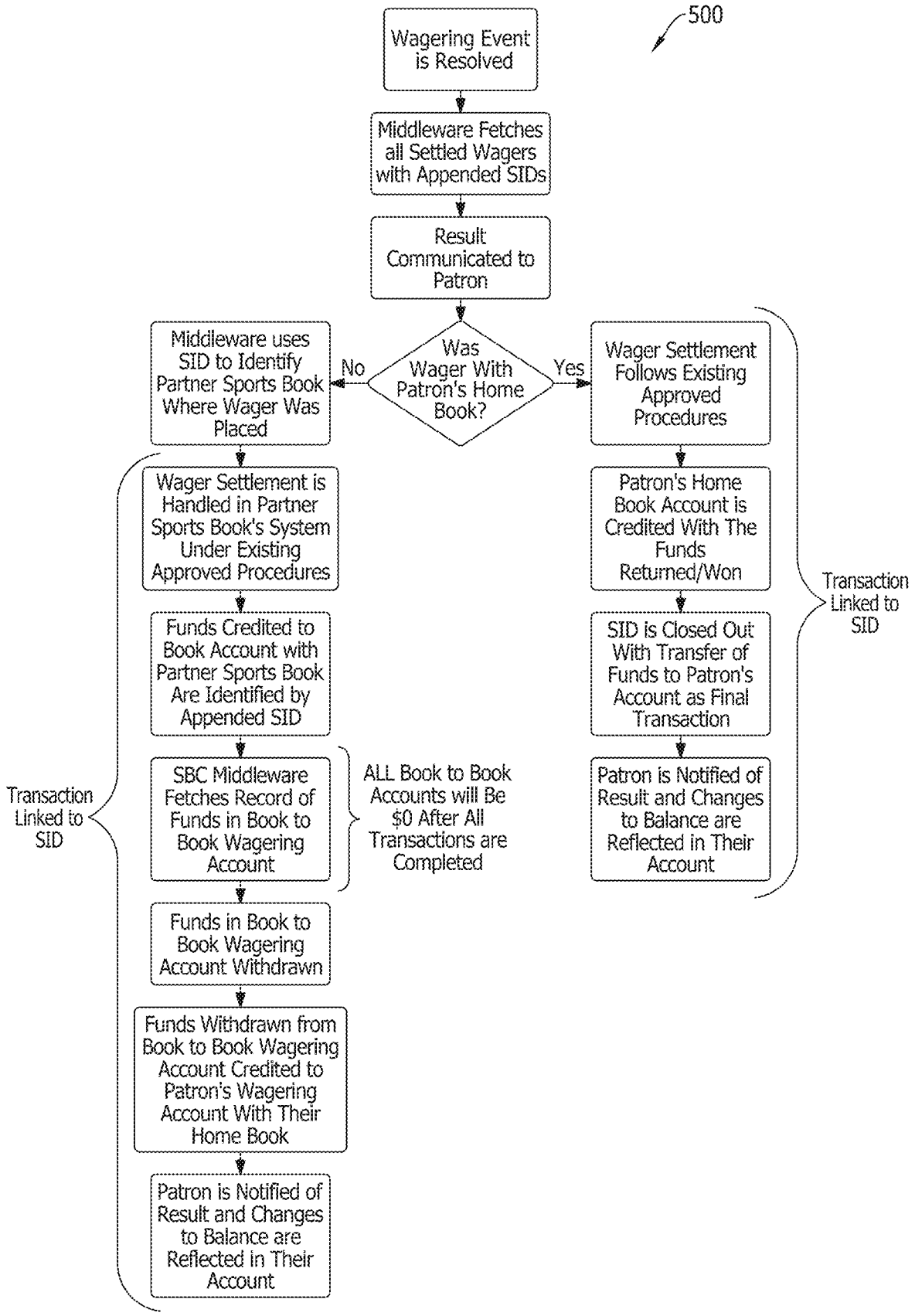
Figure 13:
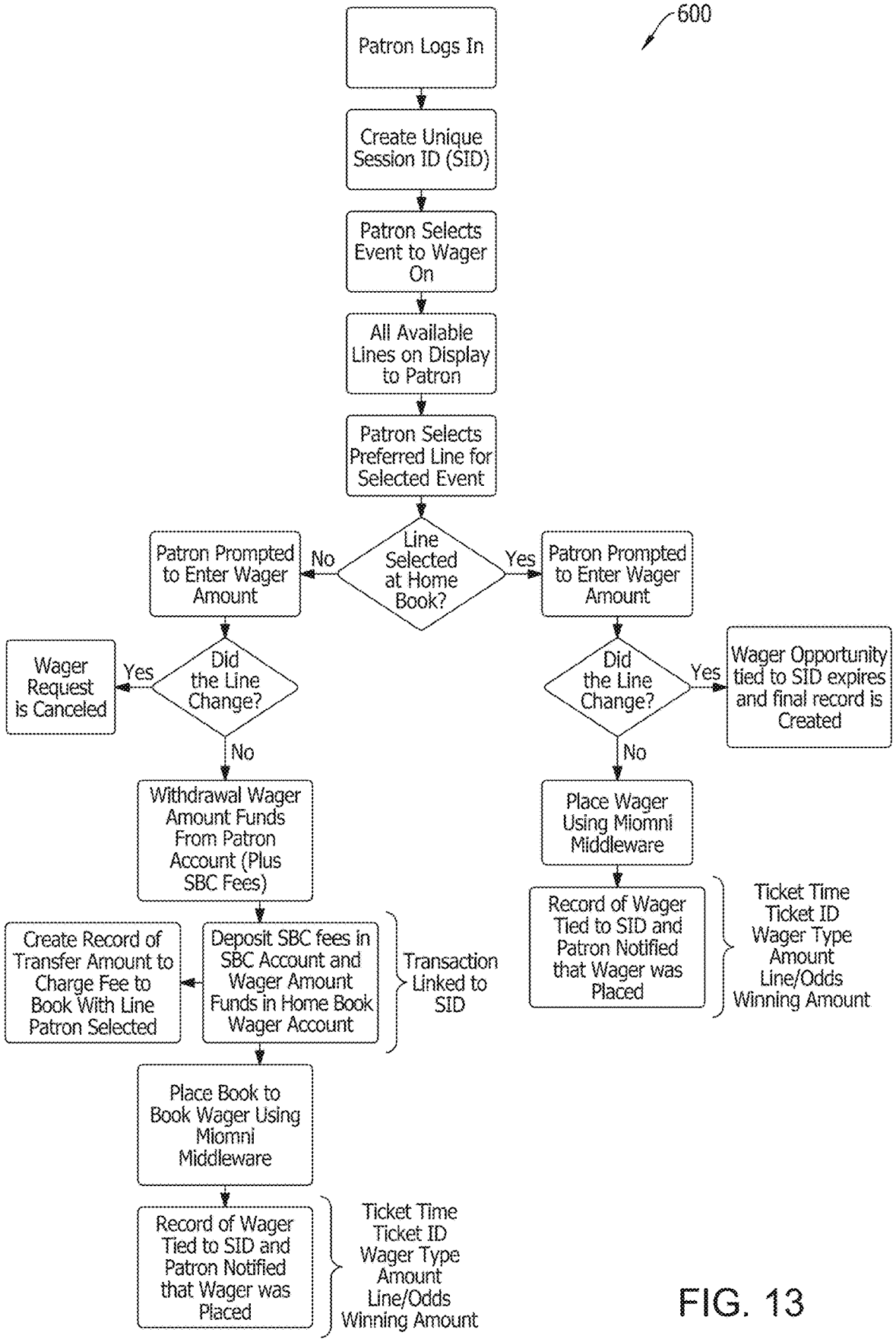
Figure 15:
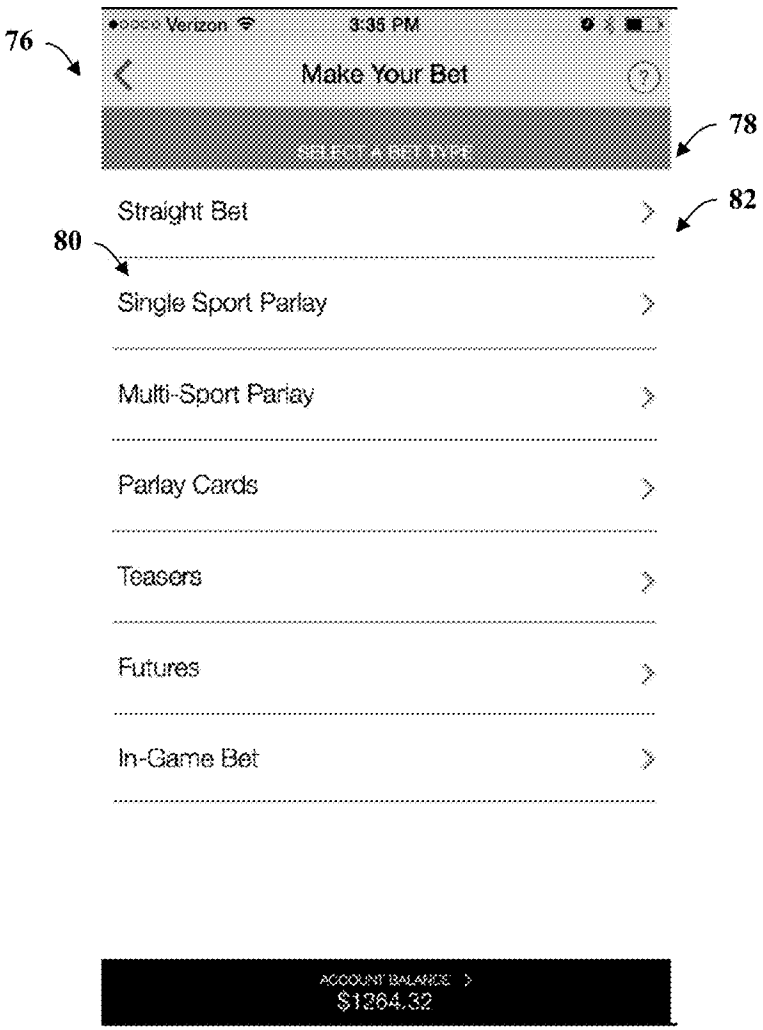
FIGS. 14-27 are exemplary screenshots of display screens that may be displayed on mobile computing devices to allow users to operate the system shown in FIGS. 1-3, according to an embodiment of the present invention.

FIGS. 12-13 illustrate flowcharts of methods 500 and 600 that may be implemented by the system 10 to and describes how the system 10 facilitates customer transactions that take place from the point of log-in to the settlement of the wager. FIG. 12 illustrates a flowchart of method 500 for a patron logging in and placing a wager. FIG. 13 illustrates a flowchart of method 600 for returning the funds of a winning wager with a Non-Home Book to the patron.

FIGS. 31-32 illustrate an example of how SBC will work with current systems in place at licensed Nevada Sports Books to append the SID to existing reports. The SBC Application enables the patron to view lines offered by Network Books and select their preferred line. Importantly, the Network Books will be responsible for all wagering activities, including setting the lines, accepting wagers, off-setting wagers between books and paying winnings. In one embodiment, each time a patron logs into the SBC Application, a SID will be created. The SID will follow every step of the wagering process and be appended to the transaction and wager records in the Network Book's system. Each SID will end upon the patron logging out of the SBC Application. Accordingly, the SID is used to trace the wagering activity and among other things identify the Network Book where the wager was placed. In addition, the patron will be able to track all transactional activity (deposits, withdrawals, open wagers and settled wagers) in a manner similar to existing approved account wagering applications.

Referring to FIGS. 31-32, in one embodiment, the system server 12 appends the unique session ID 58 to each transaction associated with the transactional activity when a SBC patron selects a wager from a book other than the patrons designated home book. For example, FIGS. 31-32 illustrate validation reports being generated under the following activity scenario which assumes a customer has an account at Westgate™ and has selected a line at Wynn™ to wager on: 1) After the patron selects a line offered by Wynn and input the desired wager amount in the app, $55.00 is withdrawn from their account with Westgate. The system server 12 appends a session ID (SBC: 2345-dsasadasdasd-as) to this transaction. 2) This $55.00 is deposited into the Westgate's account with Wynn. Session ID (SBC: 2345-dsasadasdasd-as) is appended to this transaction. 3) Westgate places the patron's selected wager with Wynn on the patron's selected wager of bet 727 Baltimore Ravens −2.5-110 for $55.00. The system will match the session ID to the ETSN in the middleware. This allows the system to show bet details on the patron's pending bets within the SBC app, as well as match the transactions once the bet has been settled. This session ID (SBC: 2345-dsasadasdasd-as) will be stored in the middleware systems to verify geolocation of all wagers. 4) Bet is won and $105.00 is paid into the Westgate's account with Wynn. 5) $105.00 is withdrawn from the Westgate's account with Wynn; session ID (SBC: 2345-dsasadasdasd-as) appended. 6) The $105.00 is deposited into the patron's account with Westgate; session ID (SBC: 2345-dsasadasdasd-as) appended.

While exemplary systems and methods, and applications of methods of the invention, have been described herein, it should also be understood that the foregoing and the attached materials, which describe a non-limiting exemplary embodiment of the invention, are only illustrative of a few particular embodiments with exemplary and/or preferred features, as well as principles of the invention, and that various modifications can be made by those skilled in the art without departing from the scope and spirit of the invention. Therefore, the described embodiments should not be considered as limiting of the scope of the invention in any way. Accordingly, the invention embraces alternatives, modifications and variations which fall within the spirit and scope of the invention as set forth herein and in the attached materials, including any equivalents thereto.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

Embodiments in accordance with the present invention may be embodied as an apparatus, method, or computer program product. Accordingly, the present invention may take the form of an entirely hardware embodiment, an entirely software embodiment (including firmware, resident software, micro-code, etc.), or an embodiment combining software and hardware aspects that may all generally be referred to herein as a "module" or "system." Furthermore, the present invention may take the form of a computer program product embodied in any tangible media of expression having computer-usable program code embodied in the media.

Any combination of one or more computer-usable or computer-readable media (or medium) may be utilized. For example, a computer-readable media may include one or more of a portable computer diskette, a hard disk, a random access memory (RAM) device, a read-only memory (ROM) device, an erasable programmable read-only memory (EPROM or Flash memory) device, a portable compact disc read-only memory (CDROM), an optical storage device, and a magnetic storage device. Computer program code for carrying out operations of the present invention may be written in any combination of one or more programming languages.

The flowchart and block diagrams in the flow diagrams illustrate the architecture, functionality, and operation of possible implementations of systems, methods, and computer program products according to various embodiments of the present invention. In this regard, each block in the flowchart or block diagrams may represent a module, segment, or portion of code, which comprises one or more executable instructions for implementing the specified logical function(s). It will also be noted that each block of the block diagrams and/or flowchart illustrations, and combinations of blocks in the block diagrams and/or flowchart illustrations, may be implemented by special purpose hardware-based systems that perform the specified functions or acts, or combinations of special purpose hardware and computer instructions. These computer program instructions may also be stored in a computer-readable media that can direct a computer or other programmable data processing apparatus to function in a particular manner, such that the instructions stored in the computer-readable media produce an article of manufacture including instruction means which implement the function/act specified in the flowchart and/or block diagram block or blocks.

Several (or different) elements discussed below, and/or claimed, are described as being "coupled", "in communication with", or "configured to be in communication with". This terminology is intended to be non-limiting, and where appropriate, be interpreted to include without limitation, wired and wireless communication using any one or a plurality of a suitable protocols, as well as communication methods that are constantly maintained, are made on a periodic basis, and/or made or initiated on an as needed basis. The term "coupled" means any suitable communications link, including but not limited to the Internet, a LAN, a cellular network, or any suitable communications link. The communications link may include one or more of a wired and wireless connection and may be always connected, connected on a periodic basis, and/or connected on an as needed basis.

A controller, computing device, or computer, such as described herein, includes at least one or more processors or processing units and a system memory. The controller typically also includes at least some form of computer readable media. By way of example and not limitation, computer readable media may include computer storage media and communication media. Computer storage media may include volatile and nonvolatile, removable and non-removable media implemented in any method or technology that enables storage of information, such as computer readable instructions, data structures, program modules, or other data. Communication media typically embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media.

The order of execution or performance of the operations in the embodiments of the invention illustrated and described herein is not essential, unless otherwise specified. That is, the operations described herein may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

In some embodiments, a processor, as described herein, includes any programmable system including systems and microcontrollers, reduced instruction set circuits (RISC), application specific integrated circuits (ASIC), programmable logic circuits (PLC), and any other circuit or processor capable of executing the functions described herein. The above examples are exemplary only, and thus are not intended to limit in any way the definition and/or meaning of the term processor.

In some embodiments, a database, as described herein, includes any collection of data including hierarchical databases, relational databases, flat file databases, object-relational databases, object oriented databases, and any other structured collection of records or data that is stored in a computer system. The above examples are exemplary only, and thus are not intended to limit in any way the definition and/or meaning of the term database. Examples of databases include, but are not limited to only including, Oracle® Database, MySQL, IBM® DB2, Microsoft® SQL Server, Sybase®, and PostgreSQL. However, any database may be used that enables the systems and methods described herein. (Oracle is a registered trademark of Oracle Corporation, Redwood Shores, Calif.; IBM is a registered trademark of International Business Machines Corporation, Armonk, N.Y.; Microsoft is a registered trademark of Microsoft Corporation, Redmond, Wash.; and Sybase is a registered trademark of Sybase, Dublin, Calif.)

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Other aspects and features of the invention can be obtained from a study of the drawings, the disclosure, and the appended claims. The invention may be practiced otherwise than as specifically described within the scope of the appended claims. It should also be noted, that the steps and/or functions listed within the appended claims, notwithstanding the order of which steps and/or functions are listed therein, are not limited to any specific order of operation.

Although specific features of various embodiments of the invention may be shown in some drawings and not in others, this is for convenience only. In accordance with the principles of the invention, any feature of a drawing may be referenced and/or claimed in combination with any feature of any other drawing.

What is claimed is:

1. A networked computer server system, comprising:

a database including a list of user account records and a list of wagering event records, each wagering event record including a receiving book ID and information associated with a wagering event including one or more betting lines, the receiving book ID associated with a receiving booking entity associated with the wagering event, each user account record including a unique user ID and a home book ID, the home book ID associated with a home booking entity having a user wagering account associated with a user; and a system server computer including a processor programmed to display information on a mobile computing device by executing an algorithm including:

receive, from the mobile computing device, a user ID associated with the user and access the database and determine a user account record associated with the received user ID;

generate a unique booking record including a unique session ID and store the unique booking record in the database;

determine a corresponding home book ID included in the user account record and modify the unique booking record to include the corresponding home book ID;

access the list of wagering events records being stored in the database and display a wagering screen on the mobile computing device including a plurality of wagering event selectors, each wagering event selector indicating a corresponding wagering event associated with a corresponding wagering event record and including a betting line;

receive, from the user via the mobile computing device, a selection of a wagering event selector and a wager amount;

identify the corresponding wagering event record associated with the selected wagering event selector;

identify the receiving book ID included in the corresponding wagering event record associated with the selected wagering event selector and modify the unique booking record to include the identified receiving book ID and the corresponding wagering event record; and generate and transmit a signal to a middleware server including the unique booking record and a request to place a wager associated with the corresponding wagering event associated with the selected wagering event selector, the middleware server identifying the home booking entity and the receiving booking entity associated with the request and processing the wager between the home booking entity and the receiving booking entity.

2. The system of claim 1, wherein the system server computer is programmed to:

receive a verification signal from the middleware server including a verification ID indicating the wager has been processed and modify the unique booking record to include the verification ID;

generate a wager verification report including the unique session ID, the corresponding home book ID, the receiving book ID, the corresponding wagering event record, and the wager amount; and store the wager verification report in the database and display a verification notification to the mobile computing device to notify the user that the wager has been placed.

3. The system of claim 2, wherein the system server computer is programmed to:

receive a confirmation signal from the middleware server including a second session ID and an outcome of a wagering event; and access the database and identify an associated wagering event record having a corresponding unique session ID matching the received second session ID;

update the identified associated wagering event record to include the outcome of the wagering event; and transmit a notification to the mobile computing device to notify the user of the outcome.

4. The system of claim 1, wherein the system server computer is programmed to:

transmit a betting line verification request to the receiving booking entity to verify information included in the corresponding wagering event record associated with the selected wagering event selector; and transmit the unique booking record to the middleware server upon receiving a verification response validating the information in the corresponding wagering event record from the receiving booking entity.

5. The system of claim 4, wherein the system server computer is programmed to receive a non-verification response from the receiving booking entity that the corresponding wagering event record is not valid and responsively display a notification to the user that the corresponding wagering event associated with the corresponding wagering event record is not available for wagering and delete the unique booking record upon receiving the non-verification response.

6. The system of claim 1, wherein the system server computer is programmed to:

receive user input via the wagering screen indicating a user defined betting line associated the corresponding wagering event record associated with the selected wagering event selector;

generate a data record including the user defined betting line and the corresponding wagering event record;

monitor betting lines associated with the corresponding wagering event associated with the corresponding wagering event record to identify a receiving book entity listing a matching betting line equal to the user defined betting line; and modify the unique booking record to the user defined betting line and a corresponding receiving book ID associated with the receiving book entity listing the matching betting line.

7. The system of claim 1, wherein each wagering event record includes event attributes associated with a plurality of event categories including a sporting event, a team, and a betting line, the system server computer is programmed to:

display a selection screen on the mobile computing device including the plurality of event categories and receive a user selection of an event category of the plurality of event categories;

display the selection screen including event attributes associated with the selected event category and receive a user selected event attribute; and select wagering event records having event attributes matching the user selected event attribute and display the wagering screen including wagering event selectors corresponding to the selected wagering event records on the mobile computing device.

8. The system of claim 7, the system server computer is programmed to:

receive, from the mobile computing device, a request to display betting lines including one or more betting line attributes; and access the database to retrieve wagering event records having betting line attributes matching the requested betting line attributes and display the wagering event selectors including betting lines included in the retrieved wagering event records.

9. One or more non-transitory computer-readable storage media, having computer-executable instructions embodied thereon, wherein when executed by at least one processor, the computer-executable instructions cause the at least one processor to:

generate and store a list of user account records and a list of wagering event records in a database, each wagering event record including a receiving book ID and information associated with a wagering event including one or more betting lines, the receiving book ID associated with a receiving booking entity associated with the wagering event, each user account record including a unique user ID and a home book ID, the home book ID associated with a home booking entity having a user wagering account associated with a user;

receive, from a mobile computing device, a user ID associated with the user and access the database and determine a user account record associated with the received user ID;

generate a unique booking record including a unique session ID and store the unique booking record in the database;

determine a corresponding home book ID included in the user account record and modify the unique booking record to include the corresponding home book ID;

access the list of wagering events records being stored in the database and display a wagering screen on the mobile computing device including a plurality of wagering event selectors, each wagering event selector indicating a corresponding wagering event associated with a corresponding wagering event record and including a betting line;

receive, from the user via the mobile computing device, a selection of a wagering event selector and a wager amount;

identify the corresponding wagering event record associated with the selected wagering event selector;

identify the receiving book ID included in the corresponding wagering event record associated with the selected wagering event selector and modify the unique booking record to include the identified receiving book ID and the corresponding wagering event record; and generate and transmit a signal to a middleware server including the unique booking record and a request to place a wager associated with the corresponding wagering event associated with the selected wagering event selector, the middleware server identifying the home booking entity and the receiving booking entity associated with the request and processing the wager between the home booking entity and the receiving booking entity.

10. The one or more non-transitory computer-readable storage media of claim 9, wherein when executed by the at least one processor, the computer-executable instructions cause the at least one processor to:

receive a verification signal from the middleware server including a verification ID indicating the wager has been processed and modify the unique booking record to include the verification ID;

generate a wager verification report including the unique session ID, the corresponding home book ID, the receiving book ID, the corresponding wagering event record, and the wager amount; and store the wager verification report in the database and display a verification notification to the mobile computing device to notify the user that the wager has been placed.

11. The one or more non-transitory computer-readable storage media of claim 10, wherein when executed by the at least one processor, the computer-executable instructions cause the at least one processor to:

receive a confirmation signal from the middleware server including a second session ID and an outcome of a wagering event; and access the database and identify an associated wagering event record having a corresponding unique session ID matching the received second session ID;

update the identified associated wagering event record to include the outcome of the wagering event; and transmit a notification to the mobile computing device to notify the user of the outcome.

12. The one or more non-transitory computer-readable storage media of claim 9, wherein when executed by the at least one processor, the computer-executable instructions cause the processor to:

transmit a betting line verification request to the receiving booking entity to verify information included in the corresponding wagering event record associated with the selected wagering event record; and transmit the unique booking record to the middleware server upon receiving a verification response validating the information in the corresponding wagering event record from the receiving booking entity.

13. The one or more non-transitory computer-readable storage media of claim 12, wherein when executed by the at least one processor, the computer-executable instructions cause the at least one processor to receive a non-verification response from the receiving booking entity that the corresponding wagering event record is not valid and responsively display a notification to the user that the corresponding wagering event associated with the corresponding wagering event record is not available for wagering and delete the unique booking record upon receiving the non-verification response.

14. The one or more non-transitory computer-readable storage media of claim 9, wherein when executed by the at least one processor, the computer-executable instructions cause the at least one processor to:

receive user input via the wagering screen indicating a user defined betting line associated the corresponding wagering event record associated with the selected wagering event selector;

generate a data record including the user defined betting line and the corresponding wagering event record;

monitor betting lines associated with the corresponding wagering event associated with the corresponding wagering event record to identify a receiving book entity listing a matching betting line equal to the user defined betting line; and modify the unique booking record to the user defined betting line and a corresponding receiving book ID associated with the receiving book entity listing the matching betting line.

15. The one or more non-transitory computer-readable storage media of claim 9, wherein each wagering event record includes event attributes associated with a plurality of event categories including a sporting event, a team, and a betting line, when executed by the at least one processor, the computer-executable instructions cause the at least one processor to:

display a selection screen on the mobile computing device including the plurality of event categories and receive a user selection of an event category of the plurality of event categories;

display the selection screen including event attributes associated with the selected event category and receive a user selected event attribute; and select wagering event records having event attributes matching the user selected event attribute and display the wagering screen including wagering event selectors corresponding to the selected wagering event records on the mobile computing device.

16. The one or more non-transitory computer-readable storage media of claim 15, wherein when executed by the at least one processor, the computer-executable instructions cause the at least one processor to:

receive, from the mobile computing device, a request to display betting lines including one or more betting line attributes; and access the database to retrieve wagering event records having betting line attributes matching the requested betting line attributes and display the wagering event selectors including betting lines included in the retrieved wagering event records.

17. A method of operating a computer system for displaying information on mobile computing devices, including the steps of:

a system server computer generating and storing a list of user account records and a list of wagering event records in a database, each wagering event record including a receiving book ID and information associated with a wagering event including one or more betting lines, the receiving book ID associated with a receiving booking entity associated with the wagering event, each user account record including a unique user ID and a home book ID, the home book ID associated with a home booking entity having a user wagering account associated with a user;

the system server computer receiving, from a mobile computing device, a user ID associated with the user and accessing the database and determine a user account record associated with the received user ID;

the system server computer generating a unique booking record including a unique session ID and storing the unique booking record in the database;

the system server computer determining a corresponding home book ID included in the user account record and modify the unique booking record to include the corresponding home book ID;

the system server computer accessing the list of wagering events records being stored in the database and displaying a wagering screen on the mobile computing device including a plurality of wagering event selectors, each wagering event selector indicating a corresponding wagering event associated with a corresponding wagering event record and including a betting line;

the system server computer receiving, from the user via the mobile computing device, a selection of a wagering event selector and a wager amount;

the system server computer identifying the corresponding wagering event record associated with the selected wagering event selector;

the system server computer identifying the receiving book ID included in the corresponding wagering event record associated with the selected wagering event selector and modifying the unique booking record to include the identified receiving book ID and the corresponding wagering event record; and the system server computer generating and transmitting a signal to a middleware server including the unique booking record and a request to place a wager associated with the corresponding wagering event associated with the selected wagering event selector, the middleware server identifying the home booking entity and the receiving booking entity associated with the request and processing the wager between the home booking entity and the receiving booking entity.

18. The method of claim 17, including the steps of:

the system server computer receiving a verification signal from the middleware server including a verification ID indicating the wager has been processed and modifying the unique booking record to include the verification ID;

the system server computer generating a wager verification report including the unique session ID, the corresponding home book ID, the receiving book ID, the corresponding wagering event record, and the wager amount; and the system server computer storing the wager verification report in the database and display a verification notification to the mobile computing device to notify the user that the wager has been placed.

19. The method of claim 18, including the steps of:

the system server computer receiving a confirmation signal from the middleware server including a second session ID and an outcome of a wagering event; and the system server computer accessing the database and identifying an associated wagering event record having a corresponding unique session ID matching the received second session ID;

updating the identified associated wagering event record to include the outcome of the wagering event; and transmit a notification to the mobile computing device to notify the user of the outcome.

20. The method of claim 17, including the steps of:

the system server computer generating each wagering event record including event attributes associated with a plurality of event categories including a sporting event, a team, and a betting line;

the system server computer displaying a selection screen on the mobile computing device including the plurality of event categories and receiving a user selection of an event category of the plurality of event categories;

the system server computer displaying the selection screen including event attributes associated with the selected event category and receiving a user selected event attribute; and the system server computer selecting wagering event records having event attributes matching the user selected event attribute and displaying the wagering screen including wagering event selectors corresponding to the selected wagering event records on the mobile computing device.

* * * * *